US007698921B2

(12) United States Patent
Almagor et al.

(10) Patent No.: US 7,698,921 B2
(45) Date of Patent: Apr. 20, 2010

(54) BACKWARD COMPATIBLE LOCK SYSTEM, KEY BLANKS AND KEYS THEREFOR

(75) Inventors: Avi Almagor, Gan Yavne (IL); Dani Markbreit, Azur (IL)

(73) Assignee: Mul-T-Lock Technologies Ltd., Yavne (IL)

( * ) Notice: Subject to any disclaimer, the term of this patent is extended or adjusted under 35 U.S.C. 154(b) by 218 days.

(21) Appl. No.: 10/535,897

(22) PCT Filed: Nov. 24, 2003

(86) PCT No.: PCT/IL03/00992

§ 371 (c)(1),
(2), (4) Date: Feb. 17, 2006

(87) PCT Pub. No.: WO2004/048724

PCT Pub. Date: Jun. 10, 2004

(65) Prior Publication Data

US 2006/0207303 A1 Sep. 21, 2006

(30) Foreign Application Priority Data

Nov. 24, 2002 (IL) ..... 153068

(51) Int. Cl.
*E05B 27/00* (2006.01)
*E05B 19/06* (2006.01)

(52) U.S. Cl. ..... 70/493; 70/409; 70/406; 70/378

(58) Field of Classification Search ..... 70/493, 70/406, 409, 419–420, 494–495, 377–378, 70/392, 407, 411
See application file for complete search history.

(56) References Cited

U.S. PATENT DOCUMENTS

| | | | | |
|---|---|---|---|---|
| 3,656,328 | A * | 4/1972 | Hughes | 70/276 |
| 3,837,197 | A * | 9/1974 | Lopez | 70/494 |
| 4,289,002 | A * | 9/1981 | Gretler | 70/358 |
| 4,399,674 | A * | 8/1983 | Tsai | 70/493 |
| 4,612,787 | A * | 9/1986 | Prunbauer et al. | 70/358 |

(Continued)

FOREIGN PATENT DOCUMENTS

EP 360462 A2 * 3/1990

(Continued)

*Primary Examiner*—Peter M Cuomo
*Assistant Examiner*—Alyson M Merlino
(74) *Attorney, Agent, or Firm*—Nixon & Vandherye P.C.

(57) ABSTRACT

A cylinder and key combination including a pin operated cylinder including a cylinder body, a plug rotatable within the cylinder body and defining a keyway and first pin assemblies and at least one second pin assembly communicating with the keyway and being selectably positionable by key cuts on a key inserted into the keyway for positioning the pin assemblies with respect to a shear line between the cylinder body and the plug to permit rotation of the plug with respect to the cylinder body and a key, including a shank defining at least one planar surface configured to define a longitudinally extending key-cut region thereon, the longitudinally extending region having formed thereon a plurality of first key cuts configured to position a plurality of first pins at a desired shear line position and having pre-formed thereon at least one second key cut configured to position a corresponding at least one second pin assembly at a desired shear line position.

9 Claims, 35 Drawing Sheets

U.S. PATENT DOCUMENTS

| | | | | | |
|---|---|---|---|---|---|
| 4,964,288 | A | * | 10/1990 | Braun et al. | 70/406 |
| 5,131,249 | A | * | 7/1992 | Baden et al. | 70/398 |
| 5,438,857 | A | * | 8/1995 | Kleinhaeny | 70/493 |
| 5,682,779 | A | * | 11/1997 | Dolev | 70/494 |
| 5,943,890 | A | | 8/1999 | Field et al. | |
| 6,105,404 | A | * | 8/2000 | Field et al. | 70/365 |
| 6,257,033 | B1 | * | 7/2001 | Ziv-Av | 70/494 |
| 6,519,988 | B1 | * | 2/2003 | Wu | 70/358 |

FOREIGN PATENT DOCUMENTS

| | | | |
|---|---|---|---|
| GB | 2078843 | A * | 1/1982 |
| JP | 2001-040917 | | 2/2001 |
| JP | 2002-194934 | | 7/2002 |
| TW | 483466 | | 4/2002 |
| TW | 498916 | | 8/2002 |
| WO | WO 01/77466 | | 10/2001 |

* cited by examiner

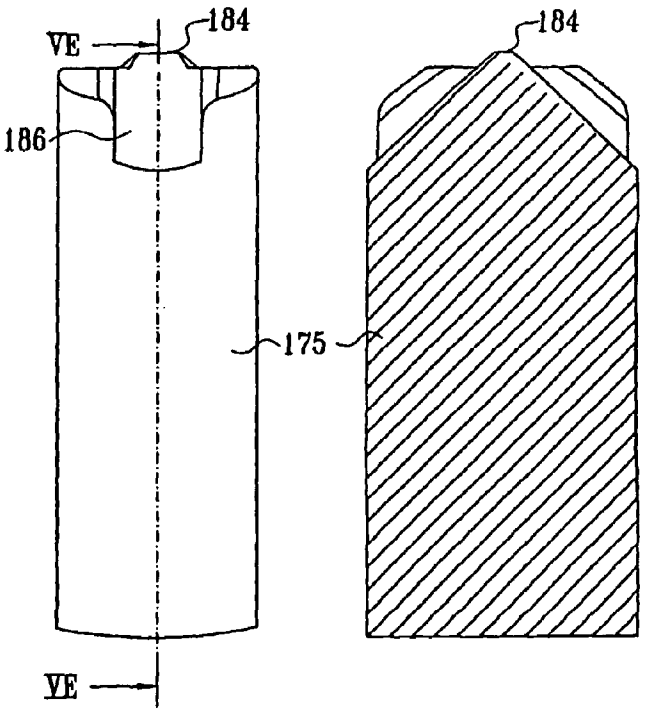
FIG. 5E
FIG. 5D
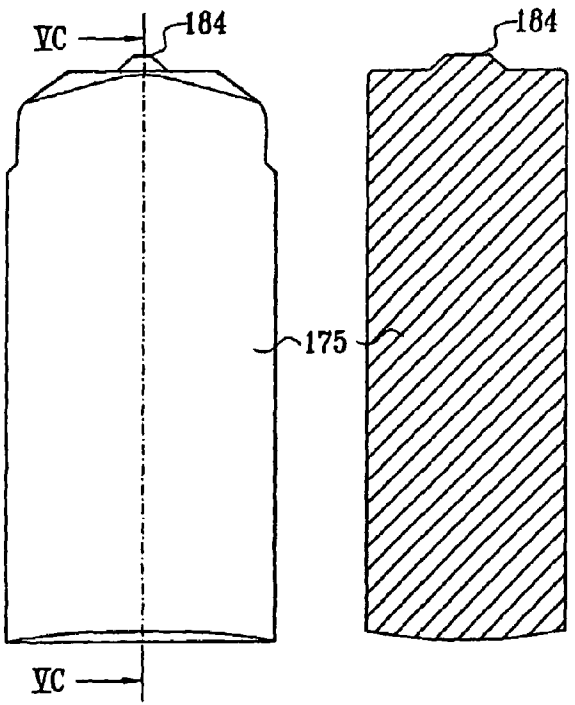
FIG. 5C
FIG. 5B
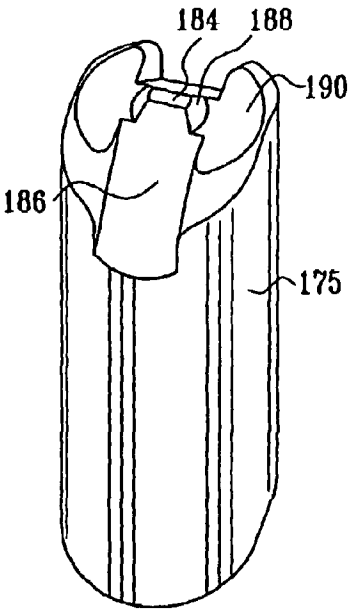
FIG. 5A
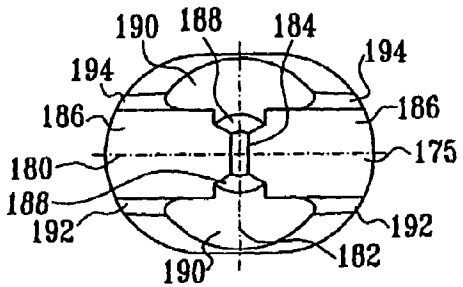
FIG. 5F

XC
XE
275
280
282
283
284
286
288
290
292

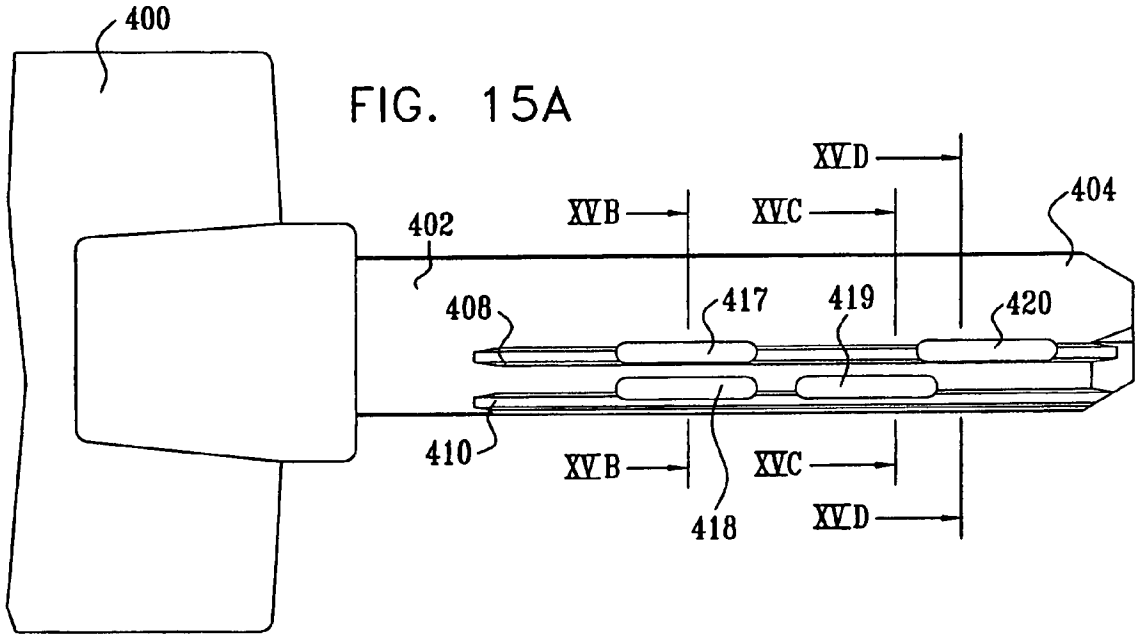
FIG. 15A
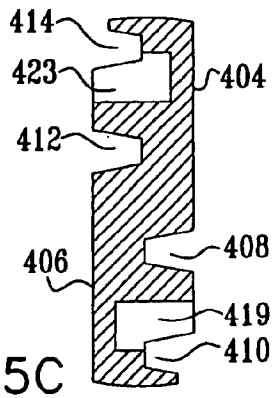
FIG. 15B
FIG. 15C
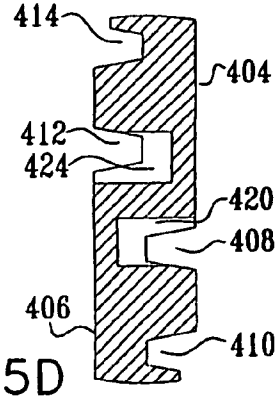
FIG. 15D

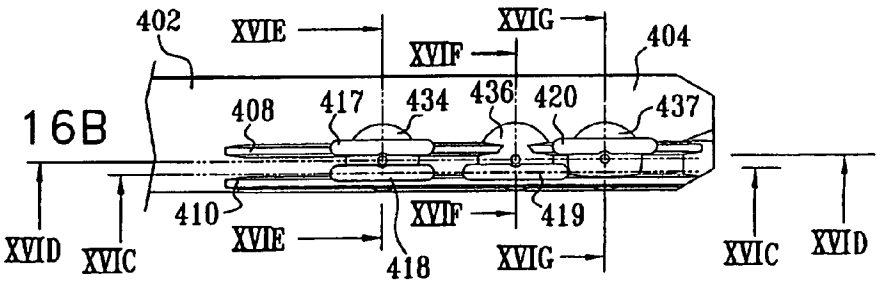
FIG. 16B
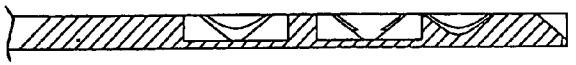
FIG. 16C
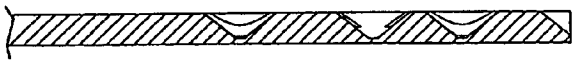
FIG. 16D
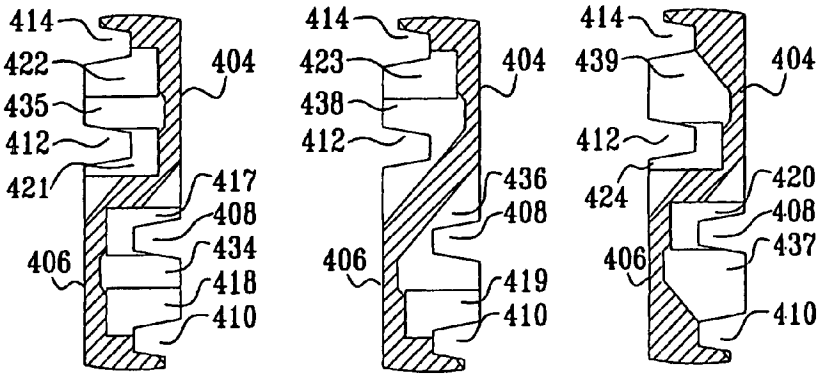
FIG. 16E
FIG. 16F
FIG. 16G
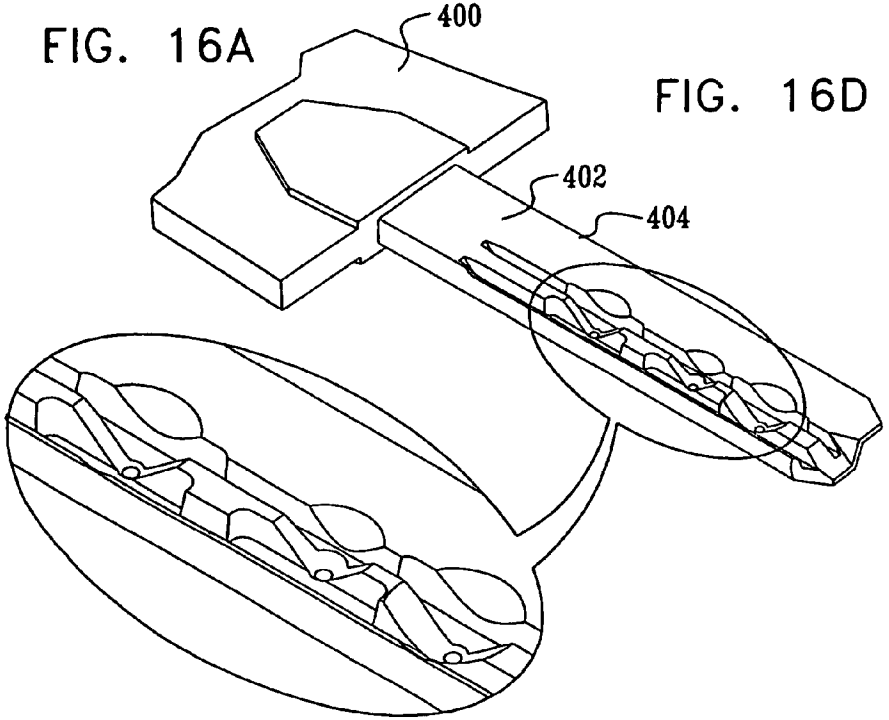
FIG. 16A

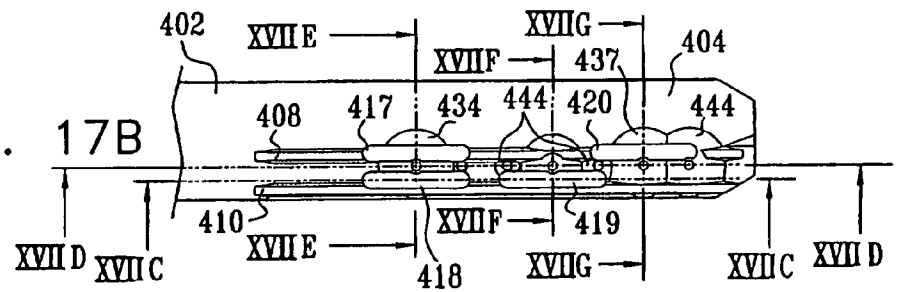
FIG. 17B
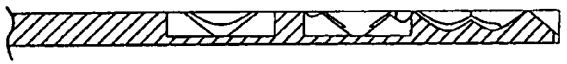
FIG. 17C
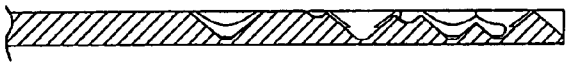
FIG. 17D
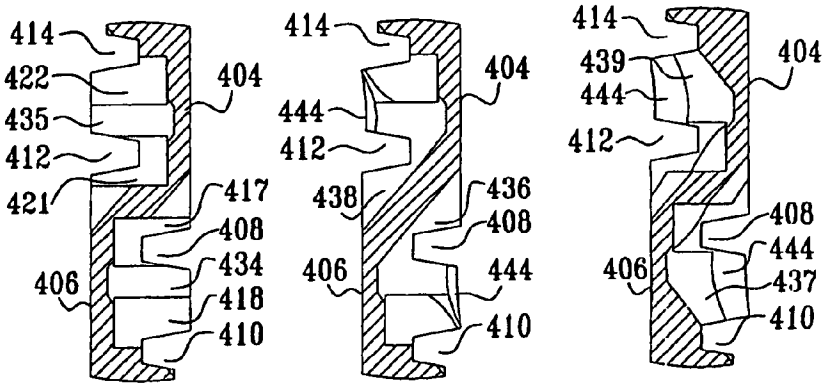
FIG. 17E
FIG. 17F
FIG. 17G
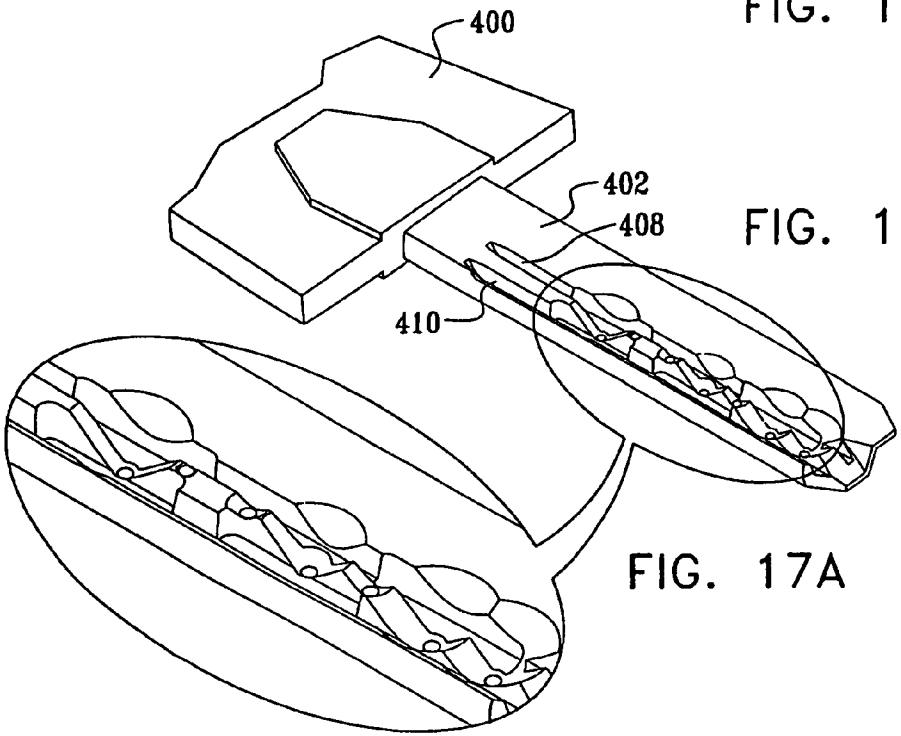
FIG. 17A

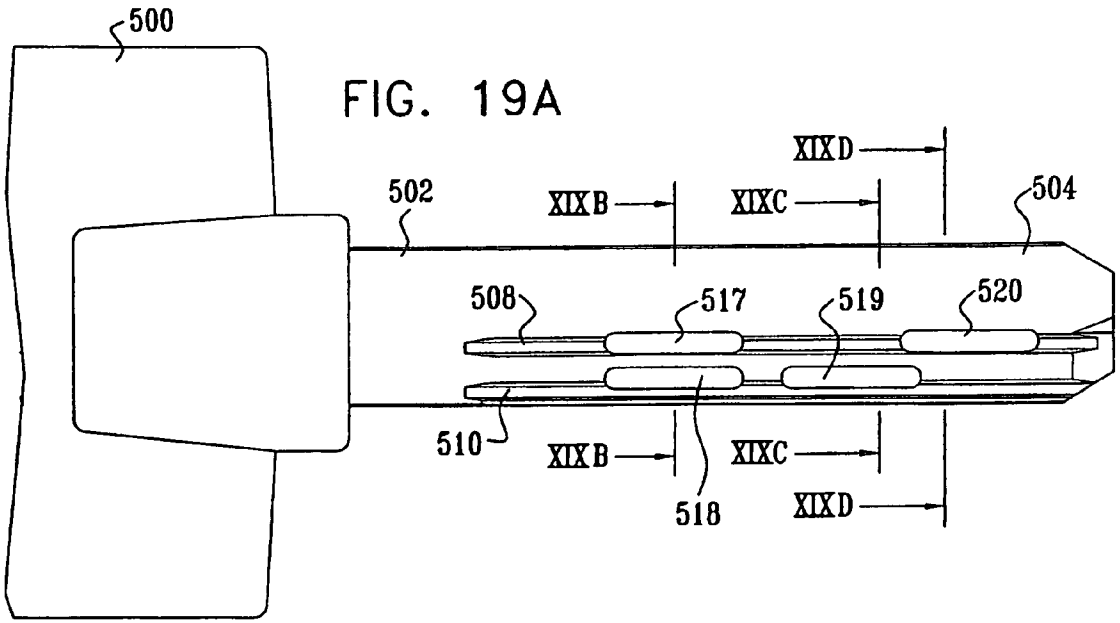
FIG. 19A
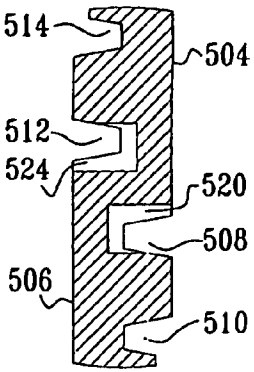
FIG. 19B
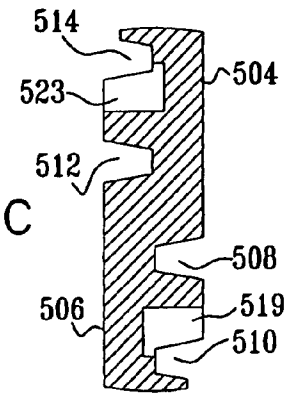
FIG. 19C
FIG. 19D

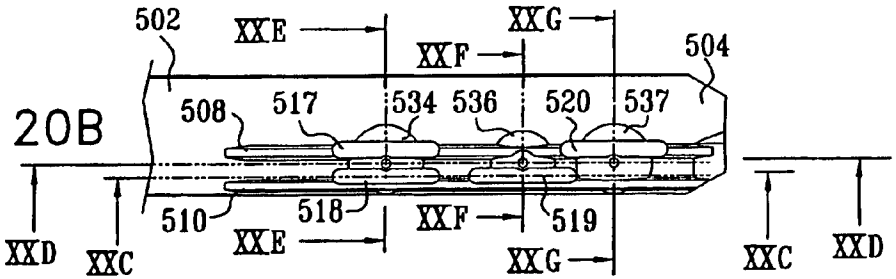
FIG. 20B
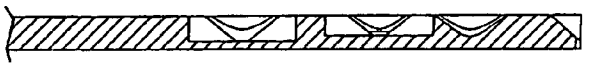
FIG. 20C
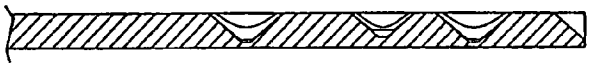
FIG. 20D
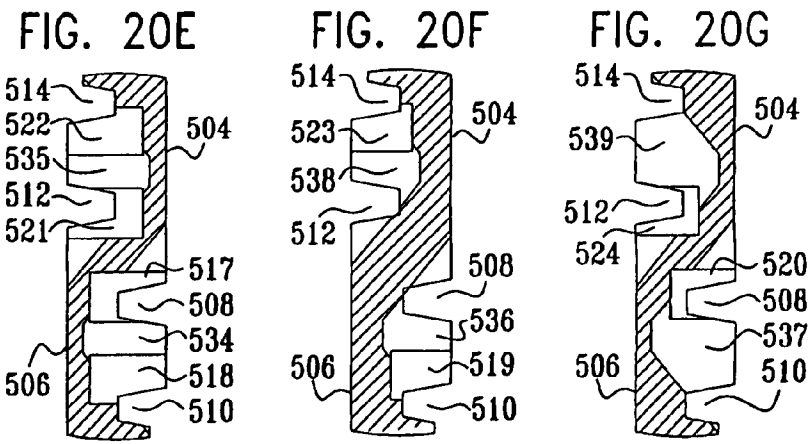
FIG. 20E
FIG. 20F
FIG. 20G
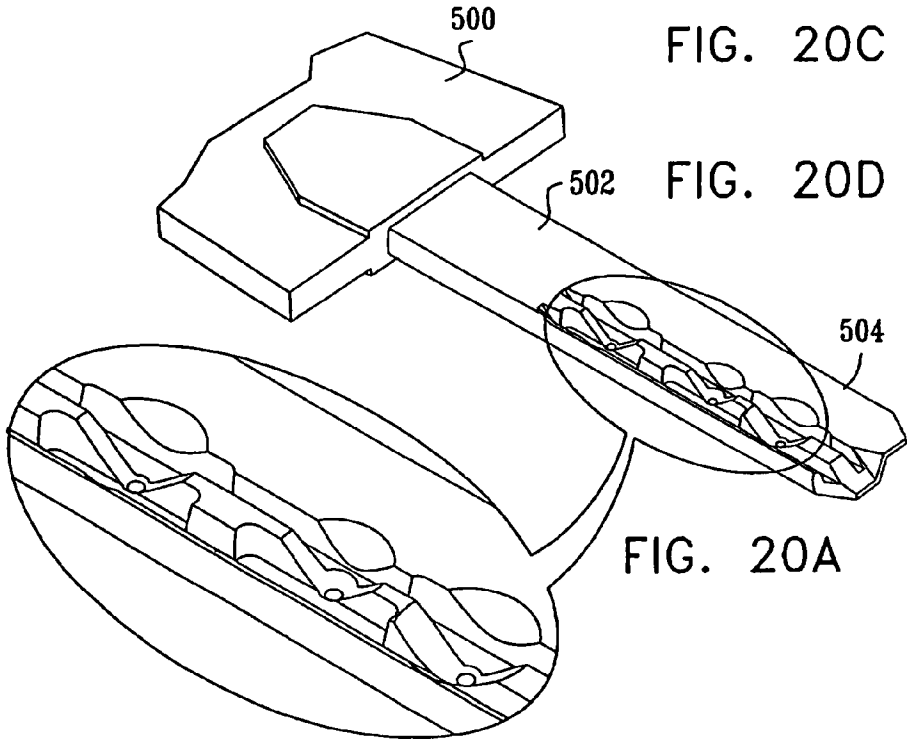
FIG. 20A

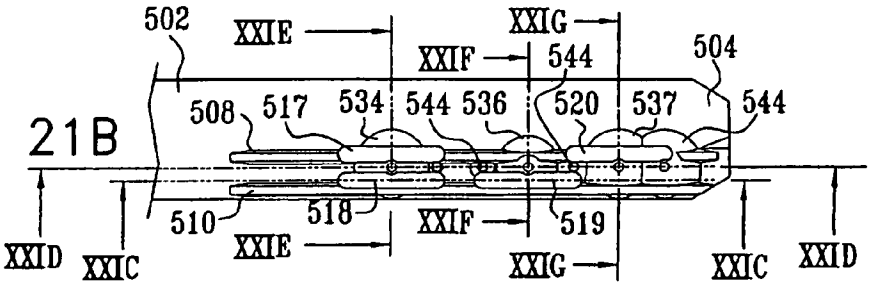
FIG. 21B
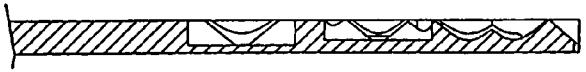
FIG. 21C
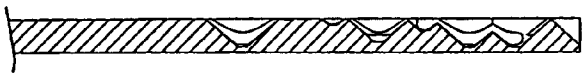
FIG. 21D
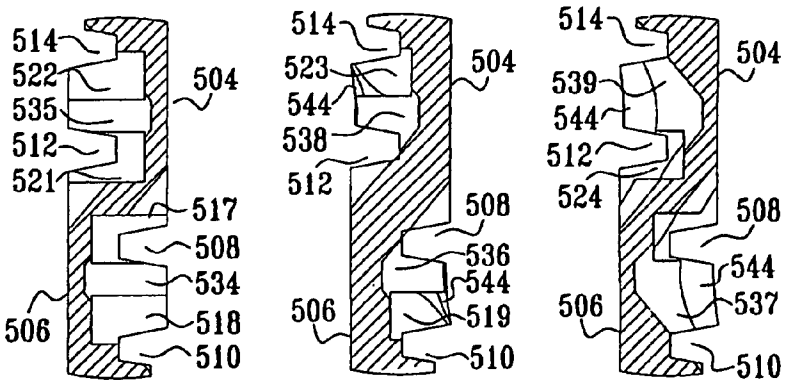
FIG. 21E
FIG. 21F
FIG. 21G
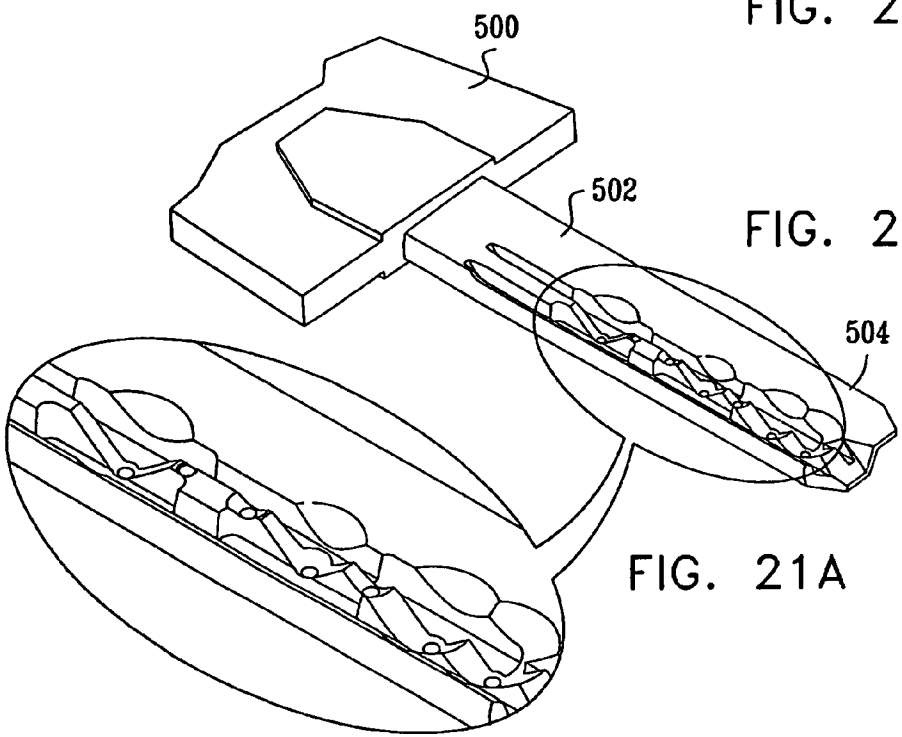
FIG. 21A FIG. 26A
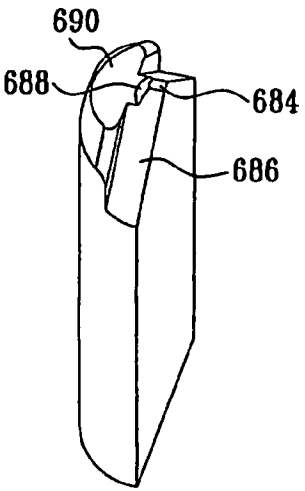
FIG. 26B
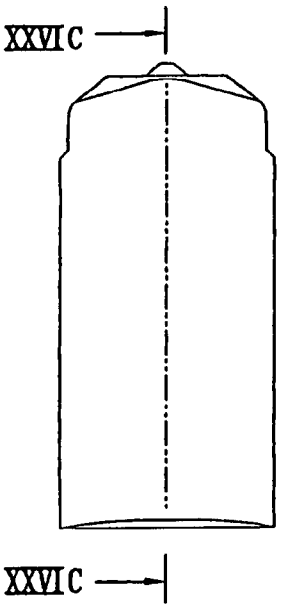
FIG. 26C
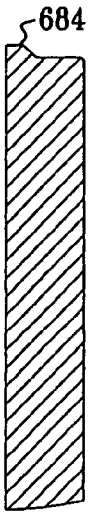
FIG. 26D
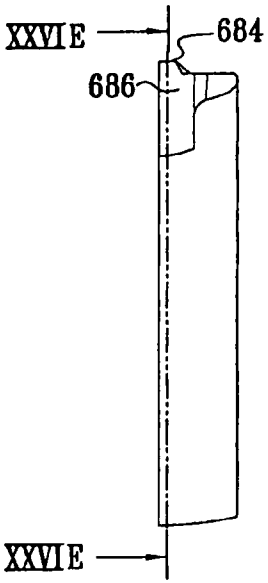
FIG. 26E
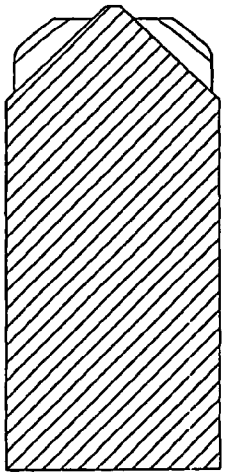
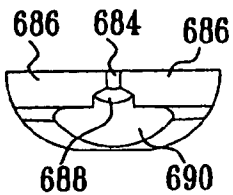
FIG. 26F

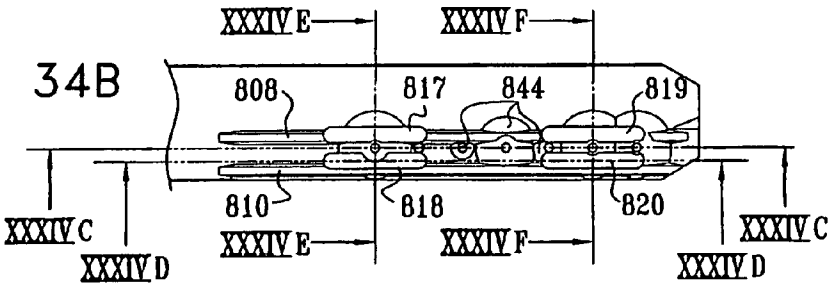
FIG. 34B
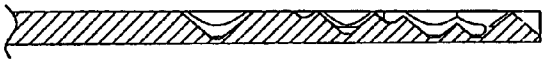
FIG. 34C
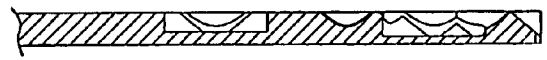
FIG. 34D
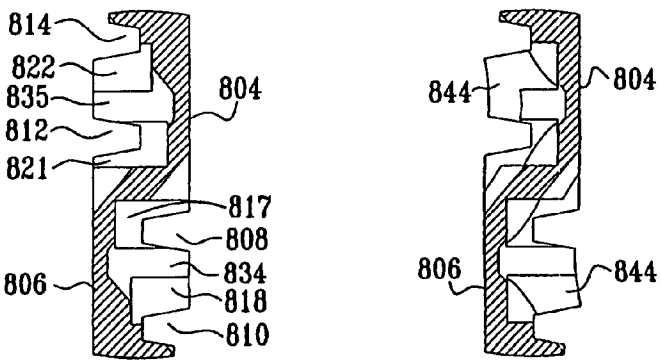
FIG. 34F
FIG. 34E
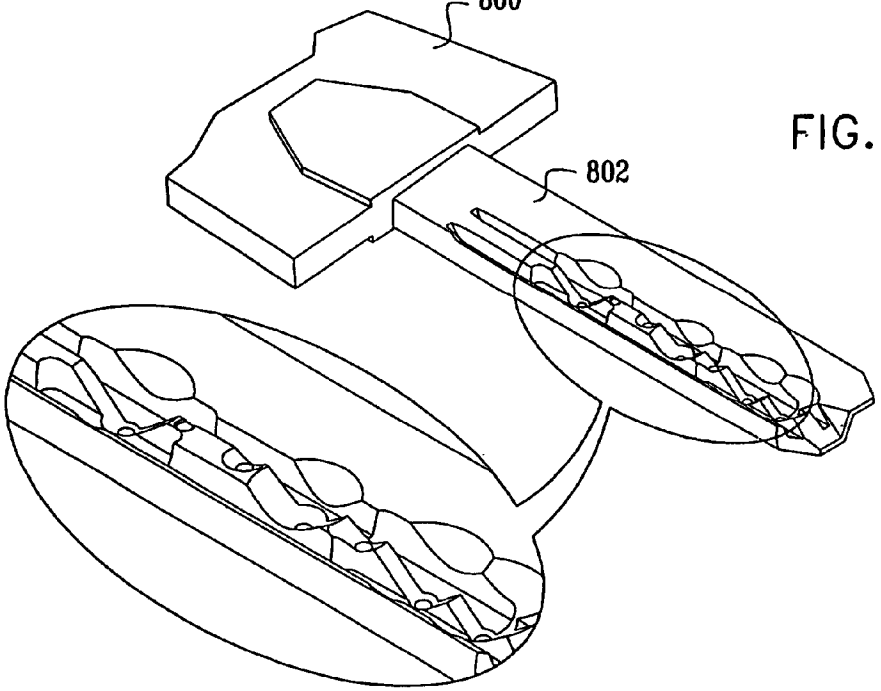
FIG. 34A

BACKWARD COMPATIBLE LOCK SYSTEM, KEY BLANKS AND KEYS THEREFOR

This application is the U.S. national phase of international application PCT/IL03/00992 filed 24 Nov. 2003 which designated the U.S. and claims benefit of IL 153068, dated 24 Nov. 2002, respectively, the entire content of each of which is hereby incorporated by reference.

FIELD OF THE INVENTION

The present invention relates to key-operated locks as well as keys and key blanks useful therein.

BACKGROUND OF THE INVENTION

A great variety of key-operated locks are known in the patent literature. The following U.S. patents of the present assignee are believed to be representative of the current state of the art:

U.S. Pat. Nos. 5,839,308; 5,784,910 and 5,520,035.

SUMMARY OF THE INVENTION

The present invention seeks to provide an improved key-operated lock as well as a key and a key blank useful therein.

There is thus provided in accordance with a preferred embodiment of the present invention a key blank including a shank defining at least one planar surface configured to define a longitudinally extending key-cut region thereon, the longitudinally extending region being arranged to accommodate a plurality of first key cuts and having pre-formed thereon at least one second key cut configured to position a corresponding pin at a desired shear line position.

Preferably, the at least one second key cut defines at least a first recess portion along a surface of rotation and at least a second recess portion which is cut deeper than the surface of rotation. Additionally, the first recess portion corresponds to the overall configuration of the plurality of first key cuts.

There is also provided in accordance with a preferred embodiment of the present invention a key including a shank defining at least one planar surface configured to define a longitudinally extending key-cut region thereon, the longitudinally extending region having formed thereon a plurality of first key cuts configured to position a plurality of first pins at a desired shear line position and having pre-formed thereon at least one second key cut configured to position a corresponding at least one second pin at a desired shear line position.

Preferably, the at least one second key cut defines at least a first recess portion along a surface of rotation and at least a second recess portion which is cut deeper than the surface of rotation. Additionally, the first recess portion corresponds to the overall configuration of the plurality of first key cuts.

There is also provided in accordance with a preferred embodiment of the present invention a cylinder and key combination including a pin operated cylinder including a cylinder body, a plug rotatable within the cylinder body and defining a keyway and first pin assemblies and at least one second pin assembly communicating with the keyway and being selectably positionable by key cuts on a key inserted into the keyway for positioning the pin assemblies with respect to a shear line between the cylinder body and the plug to permit rotation of the plug with respect to the cylinder body and a key, including a shank defining at least one planar surface configured to define a longitudinally extending key-cut region thereon, the longitudinally extending region having formed thereon a plurality of first key cuts configured to position a plurality of first pins at a desired shear line position and having pre-formed thereon at least one second key cut configured to position a corresponding at least one second pin assembly at a desired shear line position.

Preferably, the plurality of first key cuts define first recesses corresponding in configuration to the first pin assemblies and the at least one second key cut defines at least a first recess portion corresponding to the first recesses and being configured to position the first pin assemblies at desired shear line positions and at least a second recess portion which is cut deeper than the first recess portion and being configured to position the at least one second pin assembly at a desired shear line position. Additionally, the plurality of first key cuts is incapable of positioning a second pin assembly at a desired shear line position. Alternatively or additionally, the at least one second key cut is capable of positioning a second pin assembly at a desired shear line position and is capable of positioning a first pin assembly at a desired shear line position. Alternatively or additionally, the second pin assembly includes multi-part pins.

There is also provided in accordance with another preferred embodiment of the present invention a key blank including a shank arranged to have formed thereon a plurality of conventional key cuts and having formed thereon at least one unconventional, backward compatible, key cut configured to position a corresponding unconventional pin at a desired shear line position and to position a corresponding conventional pin at a desired shear line position.

Preferably, the at least one unconventional key cut does not define a surface of rotation. Alternatively or additionally, the plurality of conventional key cuts defines a surface of rotation and the at least one unconventional key cut defines a portion of a surface of rotation wherein remaining portions of the surface of rotation are cut further to define a deeper recess.

There is also provided in accordance with another preferred embodiment of the present invention a key including a shank having formed thereon a plurality of conventional key cuts and at least one unconventional, backward compatible, key cut configured to position a corresponding unconventional pin at a desired shear line position and to position a corresponding conventional pin at a desired shear line position.

Preferably, the at least one unconventional key cut does not define a surface of rotation. Alternatively or additionally, the plurality of conventional key cuts defines a surface of rotation and the at least one unconventional key cut defines a portion of a surface of rotation wherein remaining portions of the surface of rotation are cut further to define a deeper recess.

There is further provided in accordance with yet another preferred embodiment of the present invention a key blank including a shank defining at least one planar surface configured to define a longitudinally extending key-cut region thereon, the longitudinally extending region being arranged to accommodate a plurality of first key cuts and having pre-formed thereon at least one second key cut configured to position a corresponding at least one second pin assembly at a desired shear line position, wherein the plurality of first key cuts define first recesses corresponding in configuration to a plurality of first pin assemblies and the at least one second key cut defines at least a first recess portion corresponding to the first recesses and being configured to position the plurality of first pin assemblies at desired shear line positions and at least a second recess portion which is cut deeper than the first recess portion and being configured to position the at least one second pin assembly at a desired shear line position.

Preferably, the plurality of first key cuts is incapable of positioning said at least one second pin assembly at a desired shear line position. Additionally, or alternatively, the at least one second key cut is capable of positioning said at least one second pin assembly at a desired shear line position and is capable of positioning a first pin assembly at a desired shear line position.

BRIEF DESCRIPTION OF THE INVENTION

The present invention will be understood and appreciated more fully from the following detailed description, taken in conjunction with the drawings in which:

FIGS. 5A-5F are six different illustrations of a cylinder plug pin useful in the cylinders of FIGS. 1A-3B which cooperates with a key of the type shown in FIGS. 1A-2B;

FIGS. 15A-15D are, respectively, a plan view and a plurality of sectional illustrations of a key blank constructed and operative in accordance with yet another preferred embodiment of the present invention;

FIGS. 16A-16G are, respectively, a pictorial illustration, a plan view illustration and a plurality of sectional illustrations of a partially key cut key blank of the type shown in FIGS. 15A-15D;

FIGS. 17A-17G are, respectively, a pictorial illustration, a plan view illustration and a plurality of sectional illustrations of a key produced from the partially key cut key blank of the type shown in FIGS. 16A-16G;

FIGS. 19A-19D are, respectively, a plan view and sectional illustrations of a key blank constructed and operative in accordance with still another preferred embodiment of the present invention;

FIGS. 20A-20G are, respectively, a pictorial illustration, a plan view illustration and a plurality of sectional illustrations of a partially key cut key blank of the type shown in FIGS. 19A-19D;

FIGS. 21A-21G are, respectively, a pictorial illustration, a plan view illustration and a plurality of sectional illustrations of a key produced from the partially key cut key blank of the type shown in FIGS. 20A-20G;

FIGS. 26A-26F are six different illustrations of part of a multi-part cylinder plug pin useful in the cylinders of FIGS. 23A-25B which cooperates with a key of the type shown in FIGS. 23A-24B;

FIGS. 34A-34F are, respectively, a pictorial illustration, a plan view illustration and a plurality of sectional illustrations of a key produced from the partially key cut key blank of the type shown in FIGS. 33A-33F; and FIGS. 35A-35F are, respectively, a pictorial illustration, a plan view illustration and a plurality of sectional illustrations of the key produced from the partially key cut key blank of the type shown in FIGS. 33A-33F in operative engagement with plug pins of the types shown in FIGS. 27A-27F.

DETAILED DESCRIPTION OF PREFERRED EMBODIMENTS

Figure 1B:
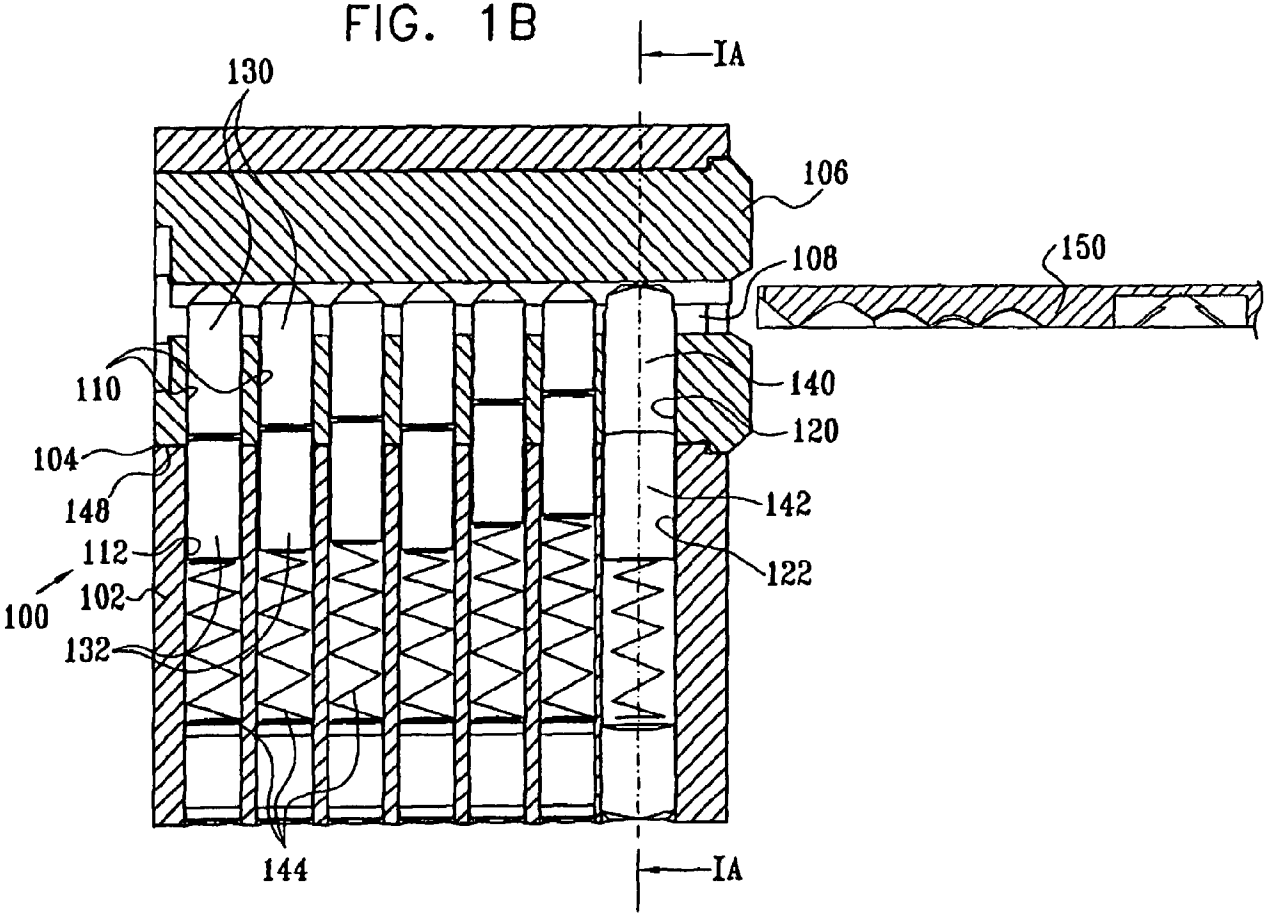
FIGS. 1A and 1B are sectional illustrations of a key-operated lock cylinder and key constructed and operative in accordance with a preferred embodiment of the invention, in a locked orientation.
Figure 1A:
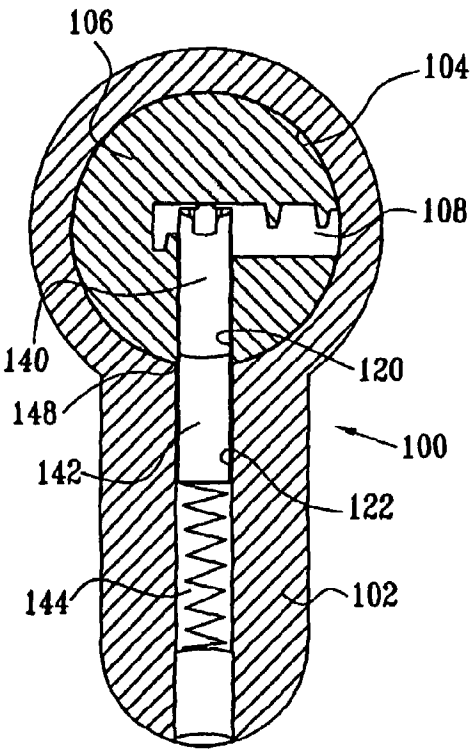

Reference is now made to FIGS. 1A and 1B, which are sectional illustrations of a key-operated lock cylinder and key, constructed and operative in accordance with a preferred embodiment of the invention, in a locked orientation. As seen in FIGS. 1A & 1B, the cylinder, here designated generally by reference numeral 100, includes a cylinder body 102 defining a bore 104. A plug 106 is rotatably disposed within bore 104 in cylinder body 102 and defines a keyway 108 and first cylindrical plug pin bores 110 communicating therewith and with corresponding first cylindrical body pin bores 112 formed in cylinder body 102.

In accordance with a preferred embodiment of the present invention, there is also provided at least one second cylindrical plug pin bore 120 communicating with keyway 108 and with at least one corresponding second cylindrical body pin bore 122 formed in cylinder body 102. Second pin bores 120 and 122 are generally distinguished from first pin bores 110 and 112 in that whereas first pin bores 110 and 112 generally have a conventional circular cylindrical configuration, second pin bores 120 and 122 typically have a non-circular cylindrical configuration, such as an oval cylindrical configuration in the illustrated embodiment.

First plug pins 130 and first body pins 132 are operatively disposed in respective first plug pin bores 110 and first body pin bores 112. Second plug pin 140 and second body pin 142 are operatively disposed in respective second plug pin bore 120 and second body pin bore 122. Springs 144 are operatively associated with the body pins 132 and 142 in a conventional manner.

Second body pins 142 are generally distinguished from first body pins 132 in that whereas first body pins 132 generally have a conventional circular cylindrical configuration, second body pins 142 typically have a non-circular cylindrical configuration, such as an oval cylindrical configuration in the illustrated embodiment.

Second plug pins 140 are generally distinguished from first plug pins 130 in that whereas first plug pins 130 generally have a conventional circular cylindrical configuration, second plug pins 140 typically have a non-circular cylindrical configuration, such as an oval cylindrical configuration in the illustrated embodiment. Second plug pins 140 are also generally distinguished from first plug pins 130 in that whereas first plug pins 130 generally have a conventional circularly symmetric, conical pin head configuration, second plug pins 140 have a non-circularly symmetric head configuration such as that shown in detail in FIGS. 5A-5F.

The first and second plug pins 130 and 140 communicate with keyway 108 and are selectably positionable by key cuts on a key when inserted into the keyway with respect to a shear line 148 between the cylinder body 110 and the plug 106 to permit rotation of the plug 106 with respect to the cylinder body 100. In FIGS. 1A and 1B, the key, here designated by reference numeral 150, is not inserted into the keyway 108 and thus the various plug and body pins are not aligned so as to be separated from each other along the shear line 148.

Figure 2B:
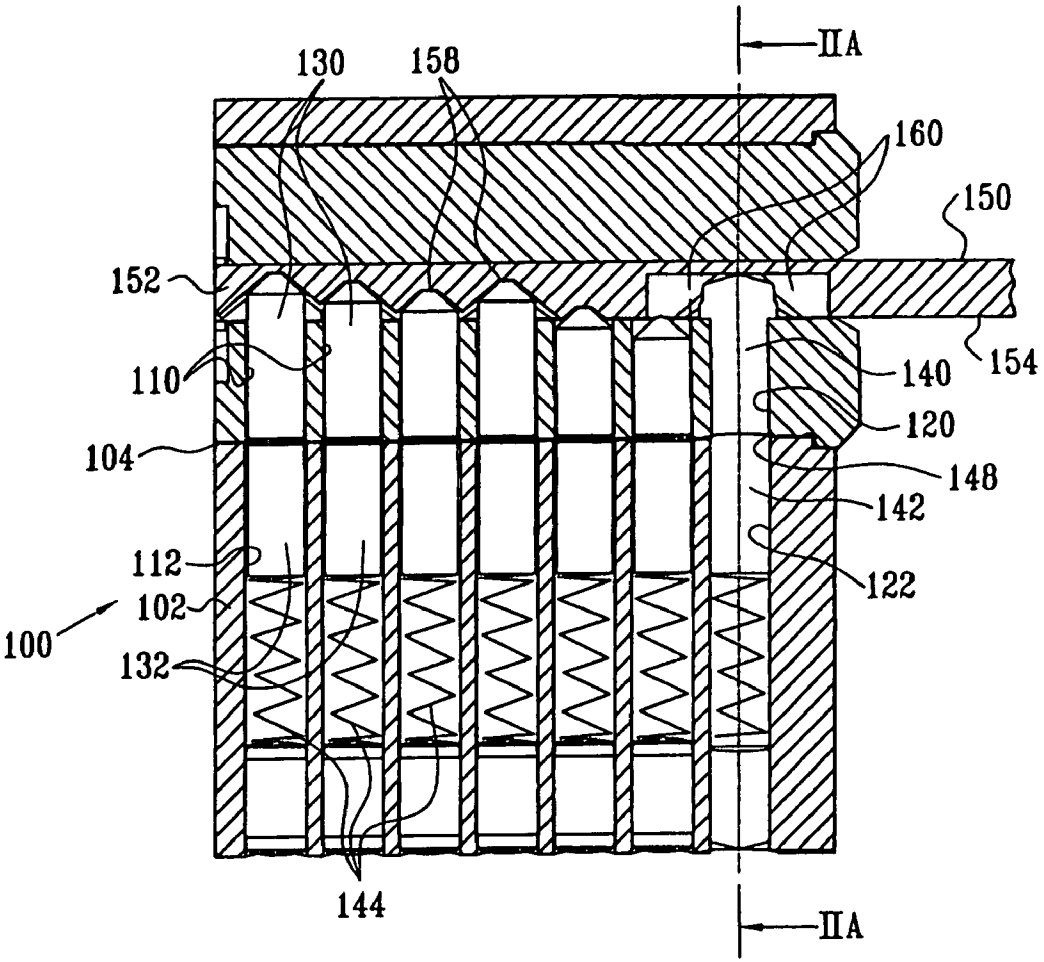
FIGS. 2A & 2B are sectional illustrations of the key-operated lock cylinder and key of FIGS. 1A and 1B in an open orientation.
Figure 2A:
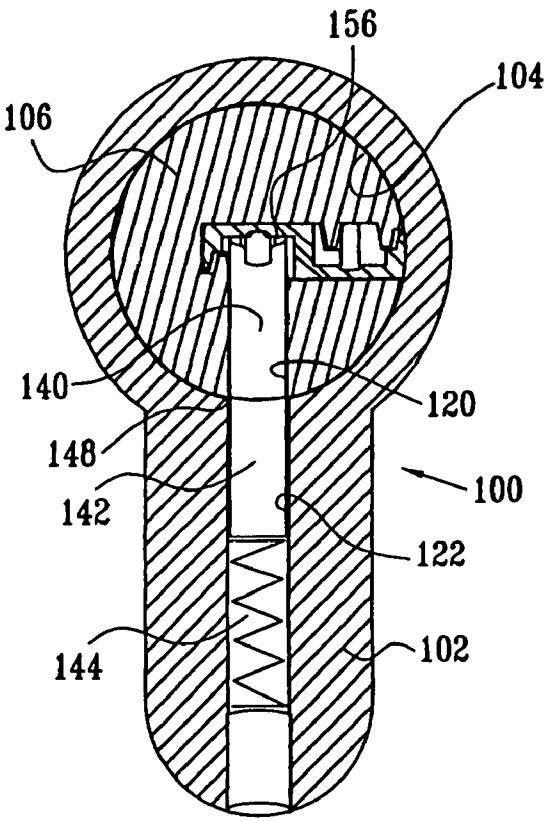

Reference is now made to FIGS. 2A and 2B, which illustrates the key-operated lock cylinder and key of FIGS. 1A and 1B in an open orientation, where key 150 is fully inserted into the keyway 108.

As seen in FIGS. 2A and 2B, key 150 includes a shank 152 defining at least one planar surface 154 configured to define a longitudinally extending key-cut region 156 thereon. The longitudinally extending region 156 has formed thereon a plurality of conventional, generally conical first key cuts 158 configured to position the engagement between the first plug pins 130 and the first body pins 132 at the shear line 148 and has at least partially pre-formed thereon at least one second key cut 160 configured in a non-conical, non-circularly symmetric configuration to position corresponding at least one second plug pin 140 and at least one second body pin 142 at shear line 148, as shown.

Figure 3B:
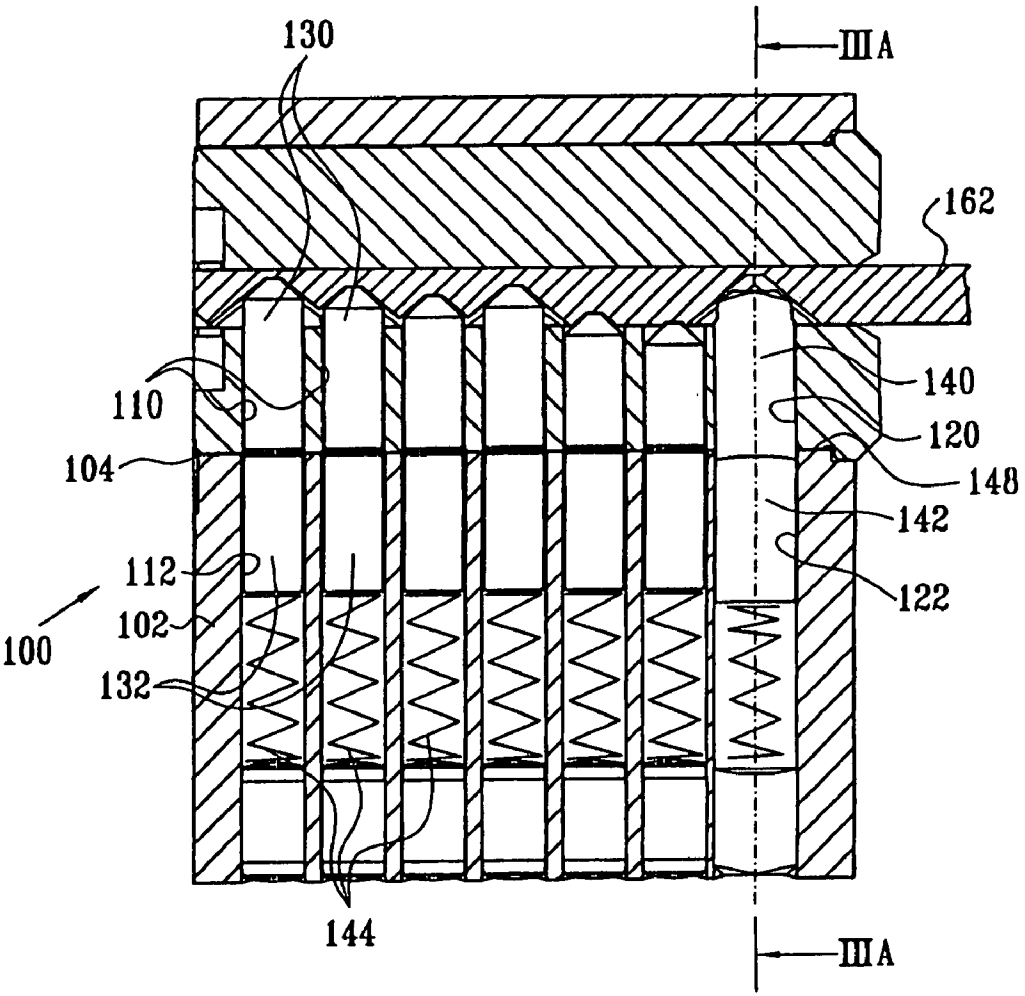
FIGS. 3A & 3B are sectional illustrations of the key-operated lock cylinder of FIGS. 1A-2B in a locked orientation with a conventional key inserted therein.
Figure 3A:
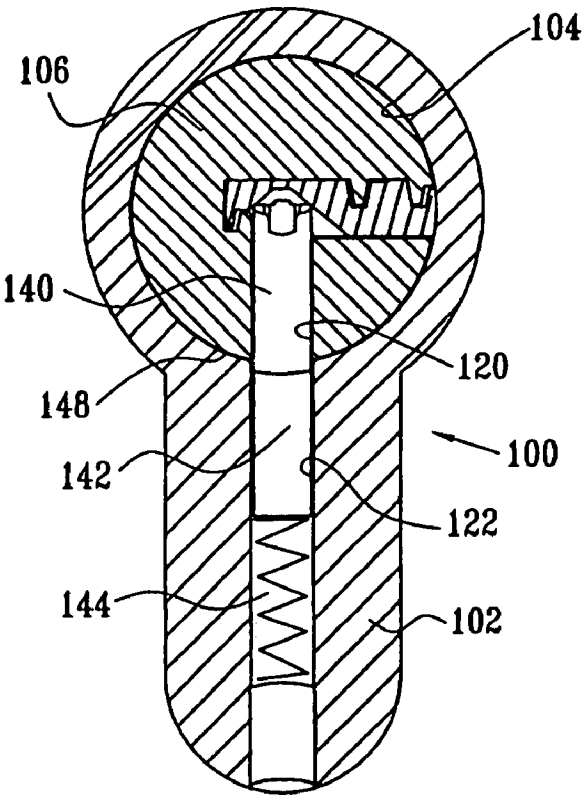

Reference is now made to FIGS. 3A & 3B, which are sectional illustrations of the key-operated lock cylinder of FIGS. 1A-2B in a locked orientation with a conventional key 162 inserted therein. It is seen that the conventional key does not include second key cuts and thus does not position the engagement of second plug pin 140 and second body pin 142 at shear line 148, as shown.

Figure 4B:
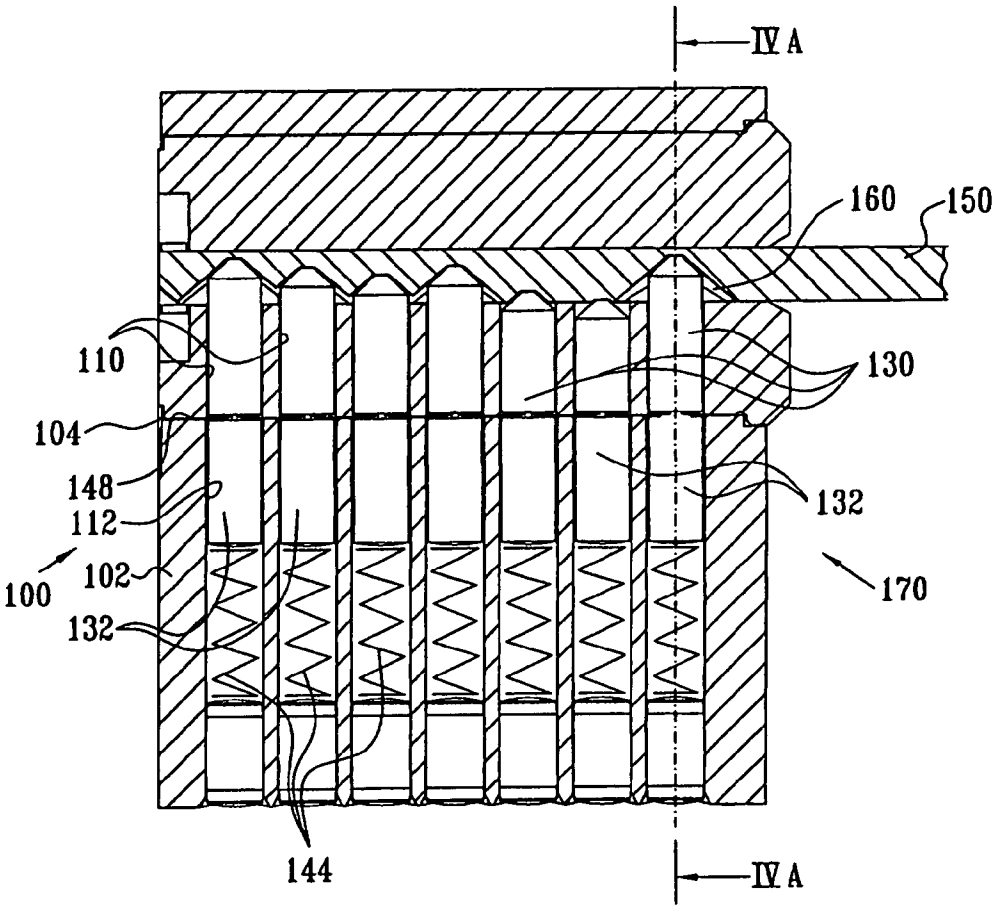
FIGS. 4A & 4B are sectional illustrations of a conventional key-operated lock cylinder in an open orientation with a key of the type shown in FIGS. 1A-2B inserted therein.
Figure 4A:
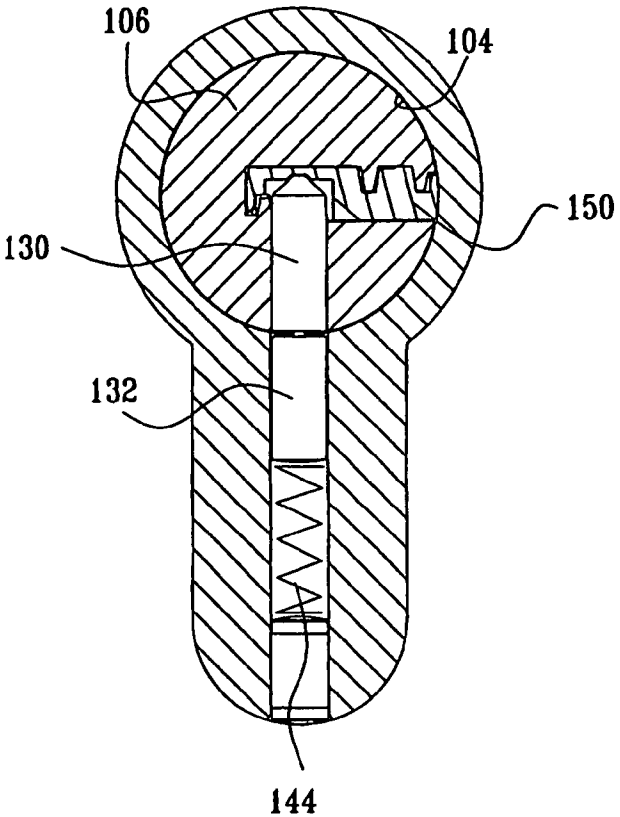

Reference is now made to FIGS. 4A & 4B, which are sectional illustrations of a conventional key-operated lock cylinder 170 in an open orientation with a key 150 of the type shown in FIGS. 1A-2B inserted therein such that a second key cut 160 is engaged by a conventional first plug pin. It is a particular feature of the present invention that the configuration of the second key cut 160 is such as to accommodate first plug pins and position the engagement of the first plug pin 130 and the first body pin 132 along the shear line 148. Thus it may be appreciated that keys bearing second key cuts are useful with conventional cylinders which do not include second pins.

Reference is now made to FIGS. 5A-5F, which are six different illustrations of a preferred second plug pin 175 useful in the cylinders of FIGS. 1A-3B which cooperates with a key of the type shown in FIGS. 1A-2B. FIG. 5A is a pictorial illustration; FIG. 5B is a side view illustration, FIG. 5C is a sectional illustration taken along lines VC-VC in FIG. 5B; FIG. 5D is a side view illustration, FIG. 5E is a sectional illustration taken along lines VE-VE in FIG. 5D and FIG. 5F is a top view.

FIGS. 5A-5F illustrate a plug pin having a generally oval cylindrical configuration defining a major axis 180 and a minor axis 182, it being appreciated that any overall configuration which does not allow rotation of the plug pin in the plug pin bore may alternatively be employed. The head of the plug pin defines an elongate generally rectangular protrusion 184 which extends along the minor axis 182 and an inclined plane 186 extending downwardly from each side of protrusion 184. Extending downwardly from each end of protrusion 184 there is a first conical surface 188 which joins a second conical surface 190. First and second interrupted elongate protrusions 192 and 194 extend on both sides of the respective second conical surfaces 190.

Figure 6B:
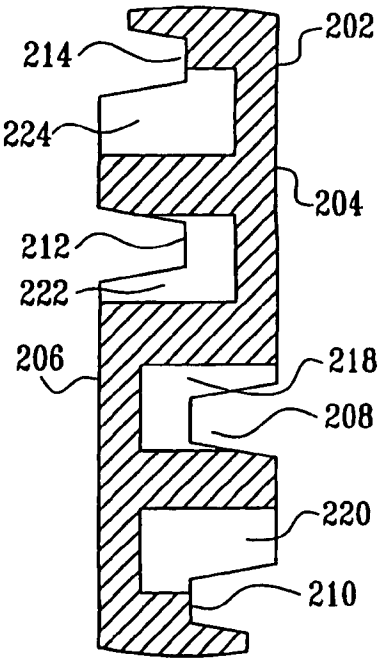
FIGS. 6A and 6B are, respectively, a plan view and sectional illustration of a key blank constructed and operative in accordance with a preferred embodiment of the present invention.
Figure 6A:
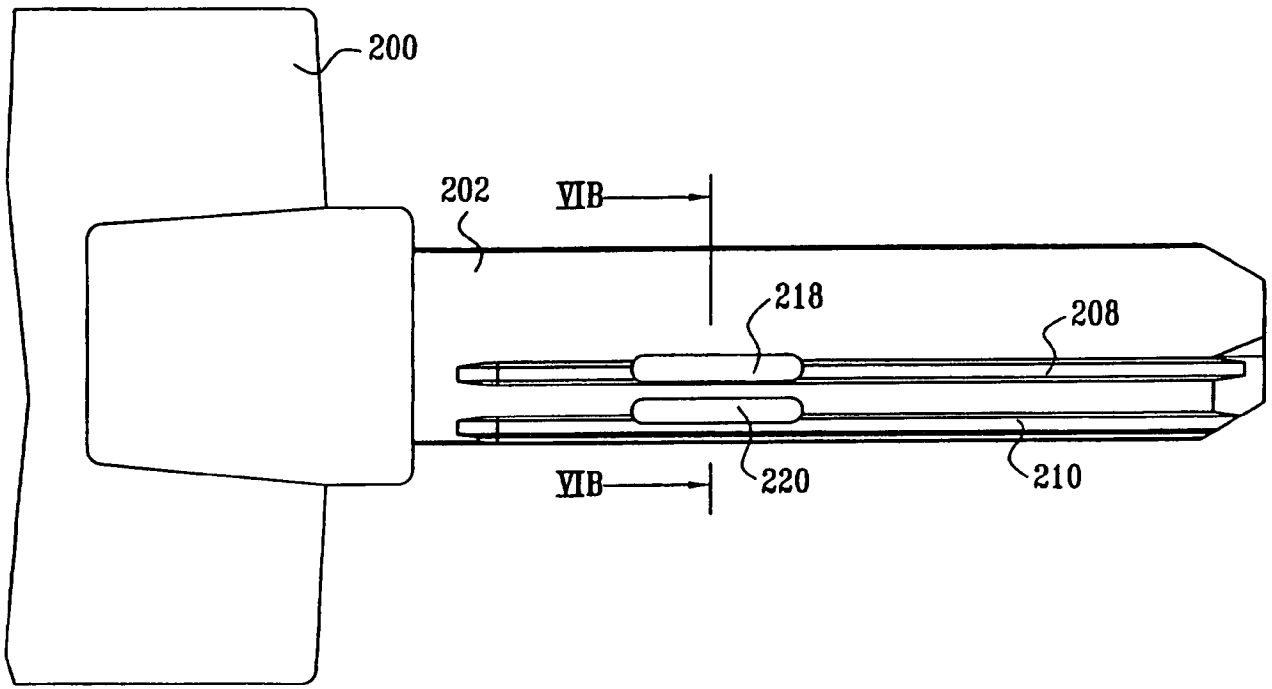
Figure 7B:
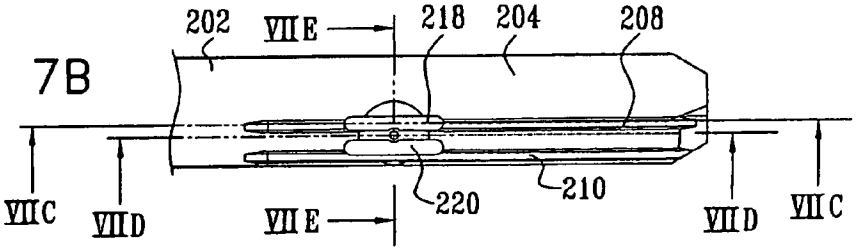
FIGS. 7A-7E are, respectively, a pictorial illustration, a plan view illustration and a plurality of sectional illustrations of a partially key cut key blank of the type shown in FIGS. 6A and 6B.
Figure 7C:
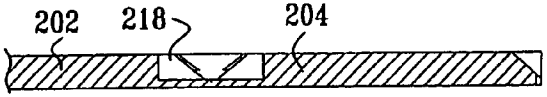
Figure 7D:
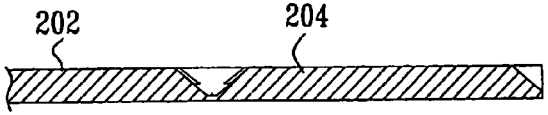
Figure 7E:
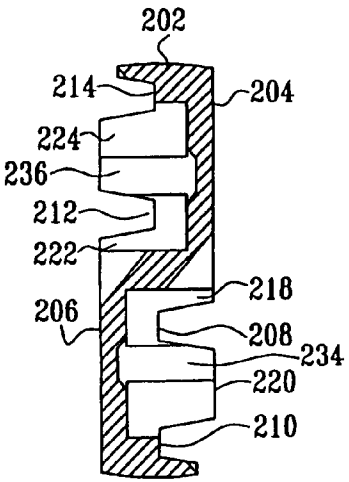
Figure 7A:
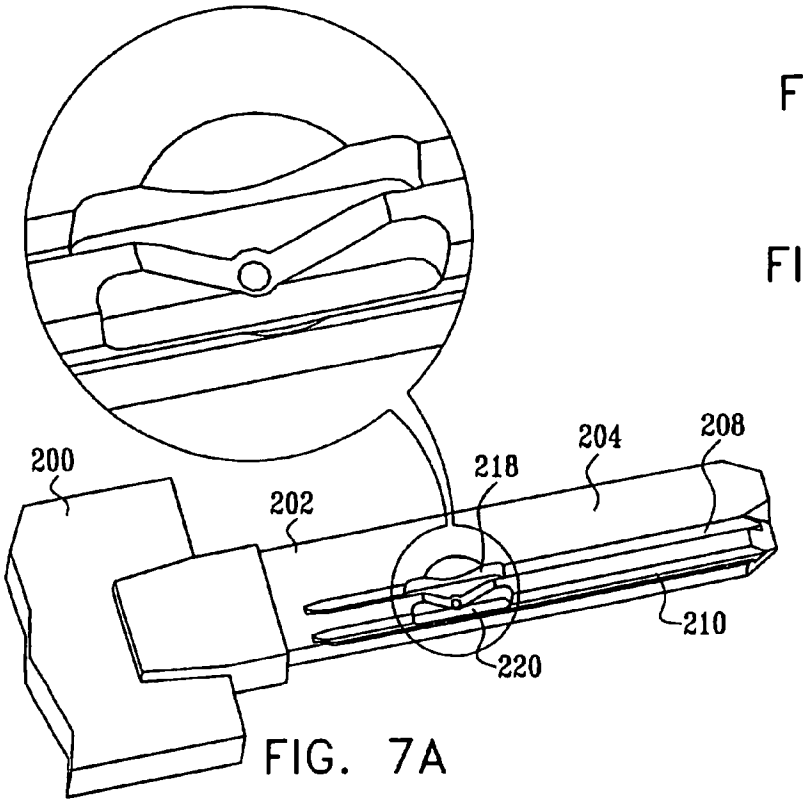
Figure 8B:
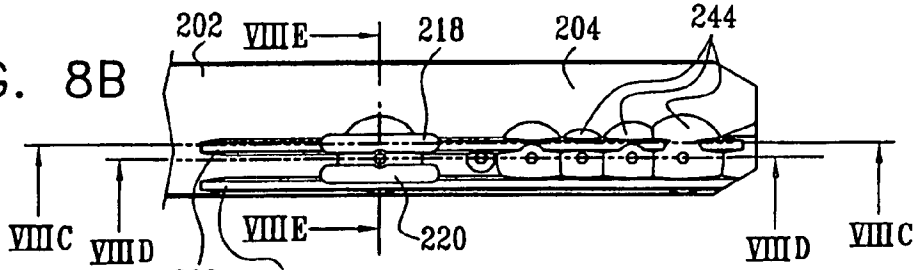
FIGS. 8A-8E are, respectively, a pictorial illustration, a plan view illustration and a plurality of sectional illustrations of a key produced from the partially key cut key blank of the type shown in FIGS. 7A-7E.
Figure 8C:
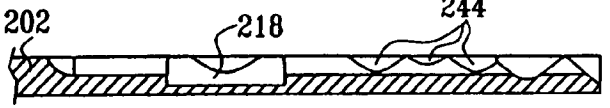
Figure 8D:
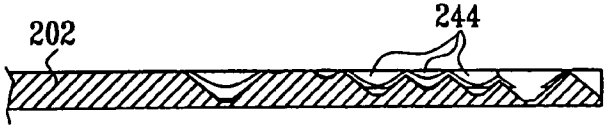
Figure 8E:
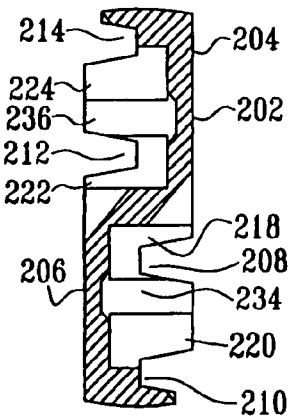
Figure 8A:
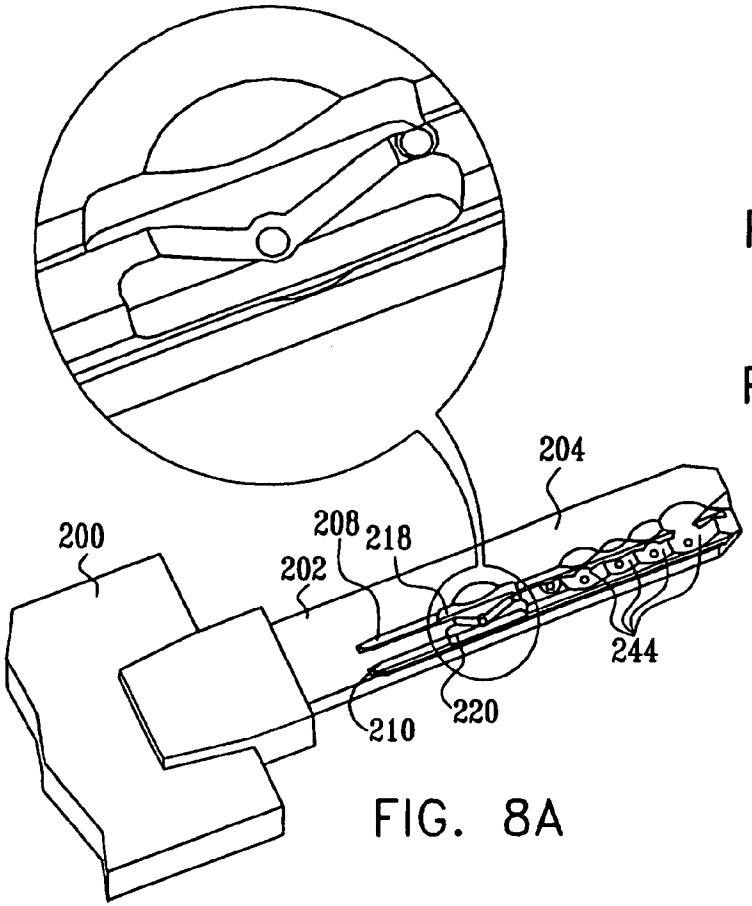
Figure 9B:
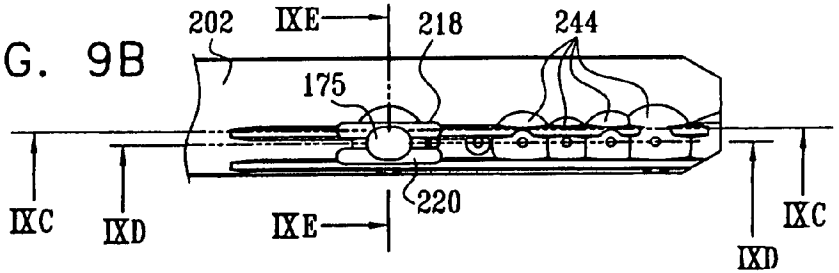
FIGS. 9A-9E are, respectively, a pictorial illustration, a plan view illustration and a plurality of sectional illustrations of the key produced from the partially key cut key blank of the type shown in FIGS. 7A-7E in operative engagement with the plug pin of FIGS. 5A-5F.
Figure 9C:
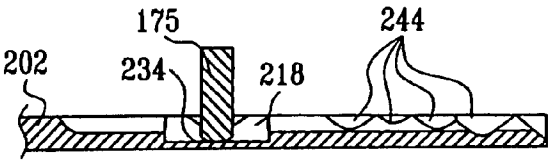
Figure 9D:
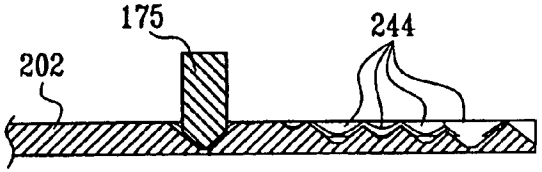
Figure 9E:
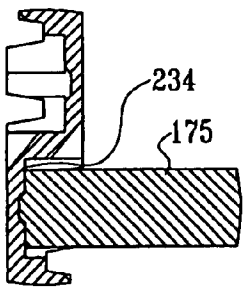
Figure 9A:
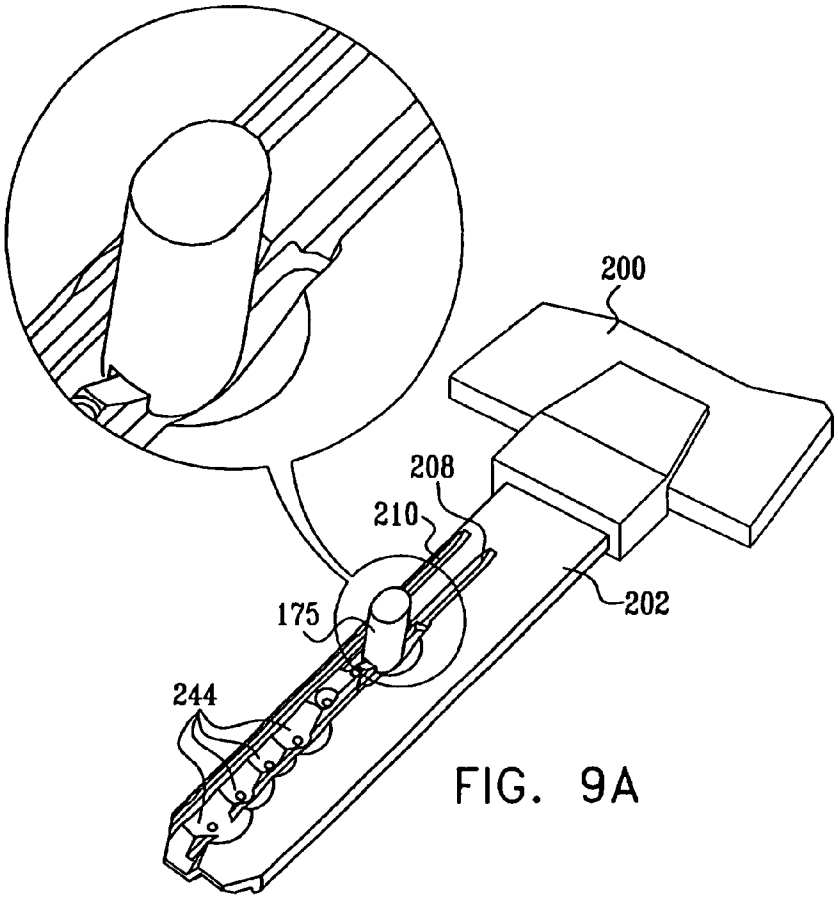

Reference is now made to FIGS. 6A and 6B, which are, respectively, a plan view and sectional illustration of a key blank constructed and operative in accordance with a preferred embodiment of the present invention. As seen in FIGS. 6A and 6B, the key blank comprises a head portion 200 and a shank portion 202, preferably in the form of a flat blade having first and second oppositely-facing planar surfaces 204 and 206. Formed on each of planar surfaces 204 and 206 are a pair of guide grooves, respectively designated by reference numerals 208 & 210 and 212 and 214, which define a key-cut region on each surface. In accordance with a preferred embodiment of the invention a pair of additional grooves are formed at at least one key cut location in the key-cut region of each of planar surfaces 204 and 206. These additional grooves are designated by reference numerals 218 & 220 and 222 and 224 respectively.

It is a particular feature of the present invention that additional grooves 218-224 define part of the second key cuts referred to hereinabove and are absent from the first key cuts referred to hereinabove.

Key blanks configured generally as shown in FIGS. 6A and 6B may have additional grooves located selectably at different key cut locations, thereby to define second key cut locations. It is appreciated that by selective distribution of key blanks of the type shown in FIGS. 6A and 6B, having given second key cut locations, cutting of keys having corresponding second key cut locations may be correspondingly restricted.

Reference is now made to FIGS. 7A-7E, which are, respectively, a pictorial illustration, a plan view illustration and a plurality of sectional illustrations of a partially key cut key blank of the type shown in FIGS. 6A and 6B. The key blank of FIGS. 7A-7E is identical to that of FIGS. 6A and 6B and is formed with an additional key cut, having a generally truncated conical configuration, similar to that of a first key cut, over each pair of additional grooves, thus fully defining a second key cut on each of planar surfaces 204 and 206. The second key cut, which is a combination of the additional grooves and the additional truncated conical key cut, is identified by reference numeral 234 on planar surface 204 and by reference numeral 236 on planar surface 206.

Key blanks configured generally as shown in FIGS. 7A-7E may have second key cuts located selectably at different key cut locations, thereby to define second key cut locations. It is appreciated that by selective distribution of key blanks of the type shown in FIGS. 7A-7E, having given second key cut locations, cutting of keys having corresponding second key cut locations may be correspondingly restricted.

Reference is now made to FIGS. 8A-8E, which are, respectively, a pictorial illustration, a plan view illustration and a plurality of sectional illustrations of a key produced from the partially key cut key blank of the type shown in FIGS. 7A-7E. The difference between the key of FIGS. 8A-8E and the key blank of FIGS. 7A-7E is in the addition of first key cuts at additional locations along the key cut region on each of planar surfaces 204 and 206. The additional key cuts are indicated generally by reference numeral 244 on planar surface 204 and are not shown on planar surface 206.

Reference is now made to FIGS. 9A-9E, which are, respectively, a pictorial illustration, a plan view illustration and a plurality of sectional illustrations of the key produced from the partially key cut key blank of the type shown in FIGS. 7A-7E in operative engagement with the plug pin of FIGS. 5A-5F. FIGS. 9A-9E illustrate engagement of plug pin 175 (FIGS. 5A-5E) with second key cut 234. It is seen that due to the provision of additional grooves 218 and 220 (FIGS. 6A and 6B) in the second key cut 234, which accommodate elongate protrusions 192 and 194 (FIGS. 5A-5E), the pin 175 is enabled to seat fully in the second key cut. It is appreciated that pin 175 could not seat fully in a first key cut. Accordingly keys which do not include suitably placed second key cuts cannot operate the non-conventional cylinders of the type described herein.

Figures 10A, 10B, 10C, 10D, 10E, 10F:
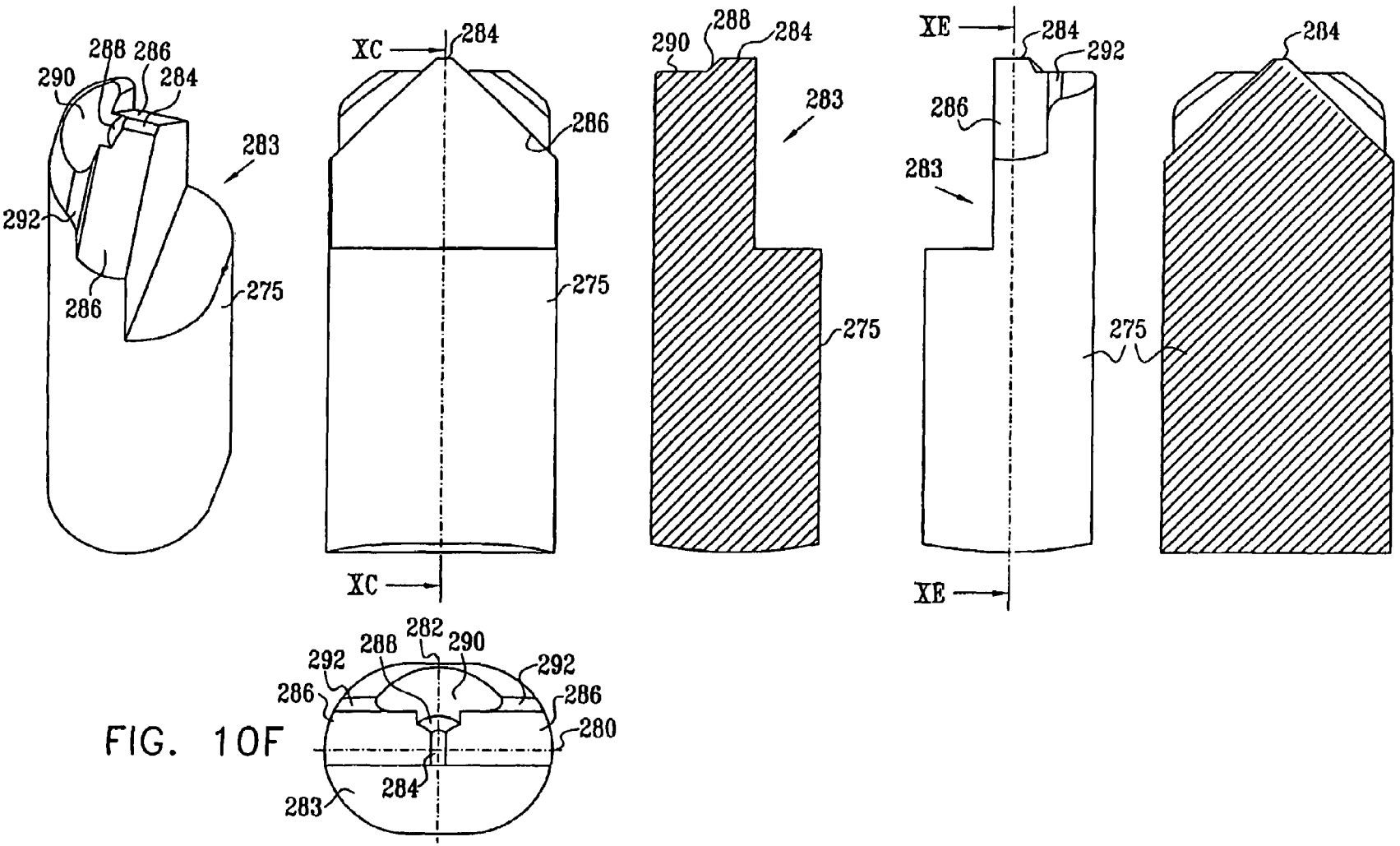
FIGS. 10A-10F are six different illustrations of another embodiment of a cylinder plug pin useful in the cylinders of FIGS. 1A-3B.
Figure 11B:
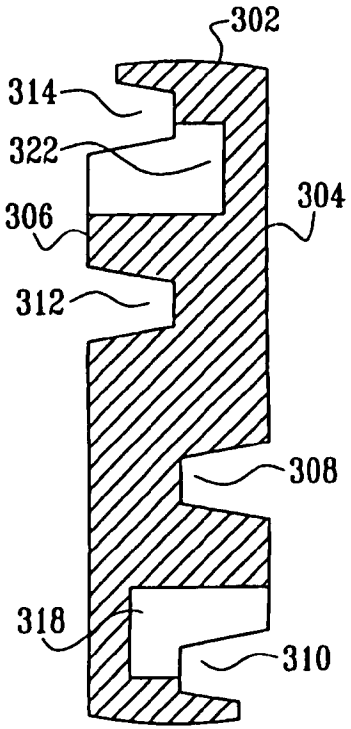
FIGS. 11A and 11B are, respectively, a plan view and sectional illustration of a key blank constructed and operative in accordance with another preferred embodiment of the present invention.
Figure 11A:
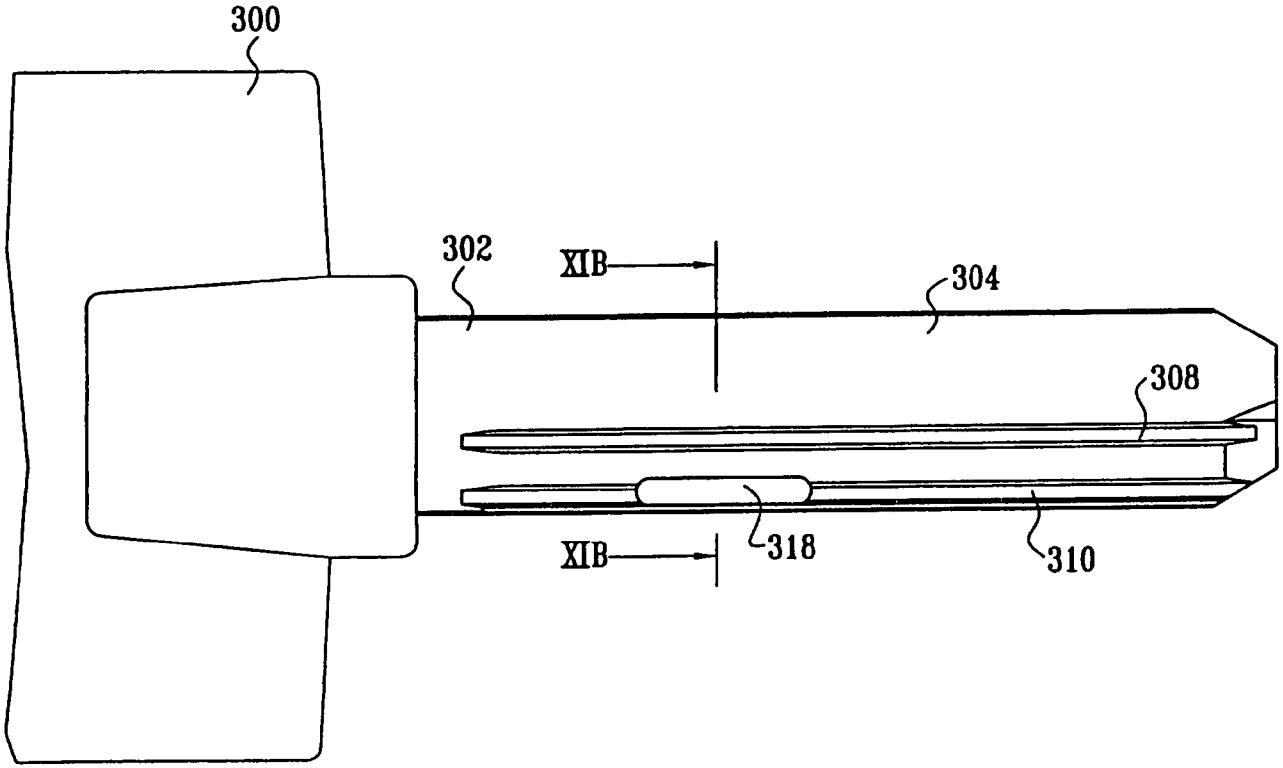
Figure 12B:
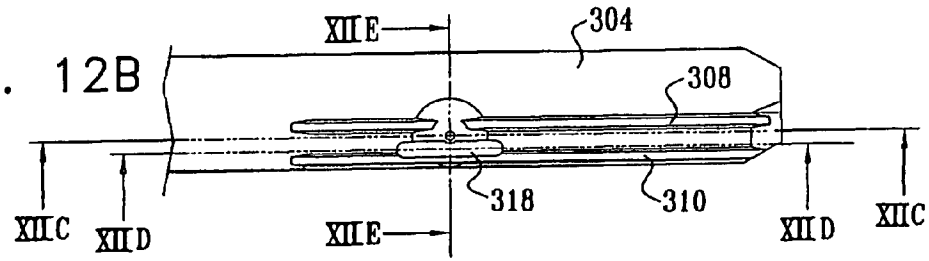
FIGS. 12A-12E are, respectively, a pictorial illustration, a plan view illustration and a plurality of sectional illustrations of a partially key cut key blank of the type shown in FIGS. 11A and 11B.
Figure 12C:
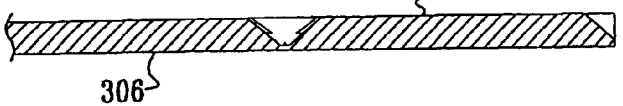
Figure 12D:
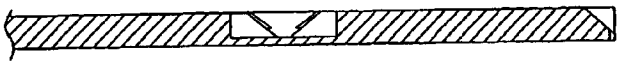
Figure 12E:
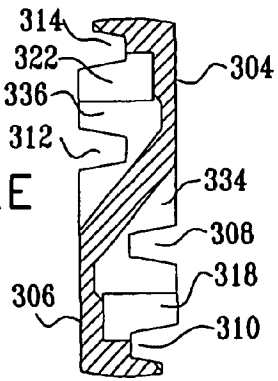
Figure 12A:
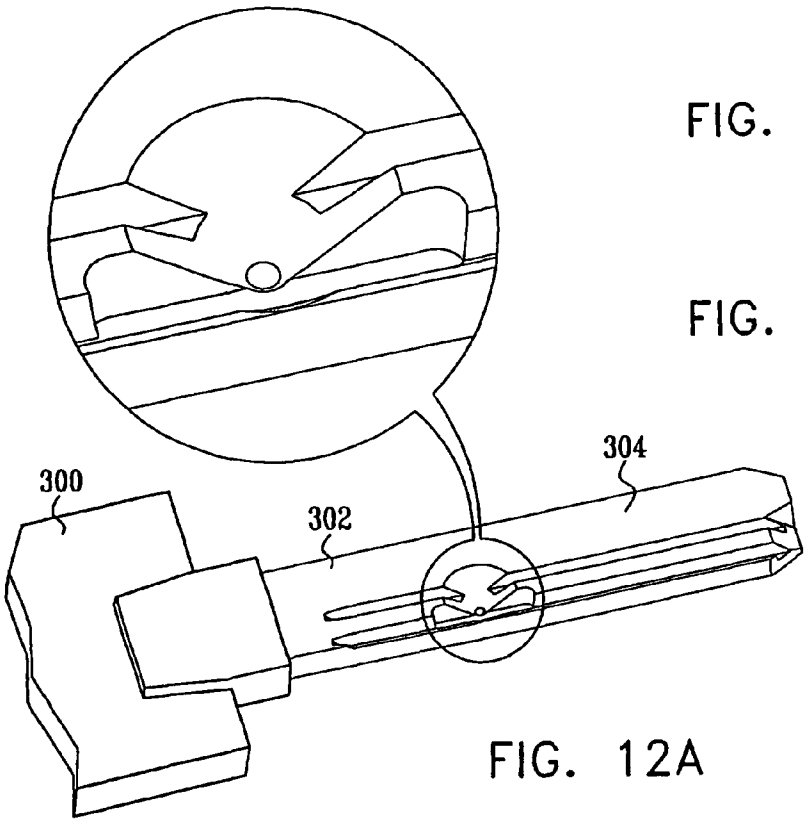
Figure 13B:
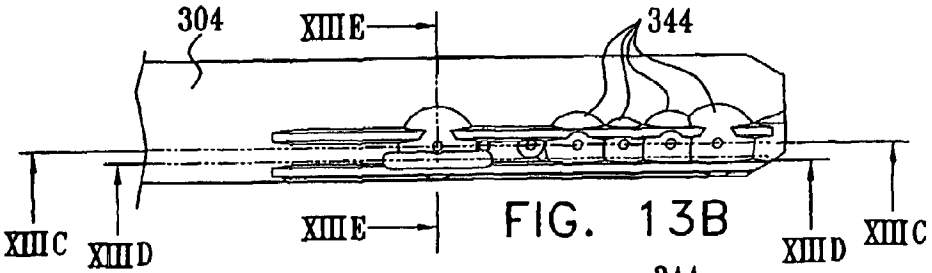
FIGS. 13A-13E are, respectively, a pictorial illustration, a plan view illustration and a plurality of sectional illustrations of a key produced from the partially key cut key blank of the type shown in FIGS. 12A-12E.
Figure 13C:
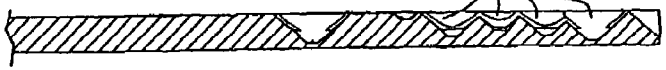
Figure 13D:
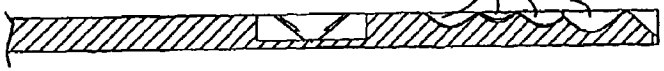
Figure 13E:
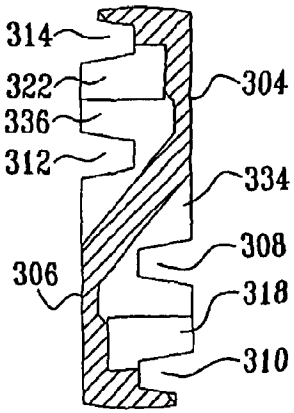
Figure 13A:
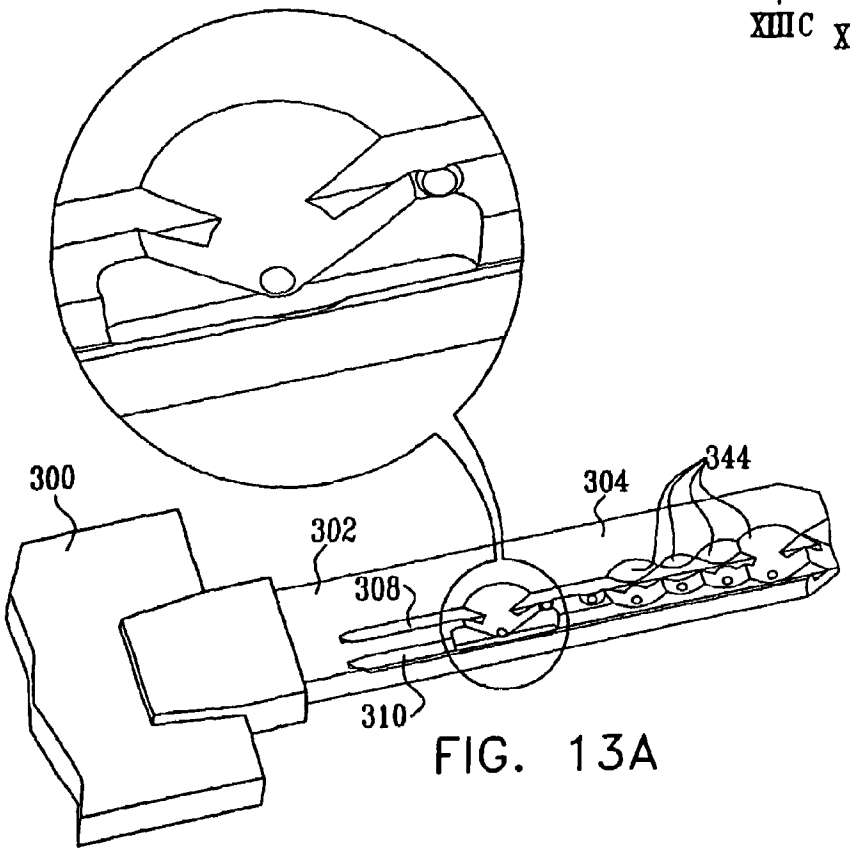
Figure 14B:
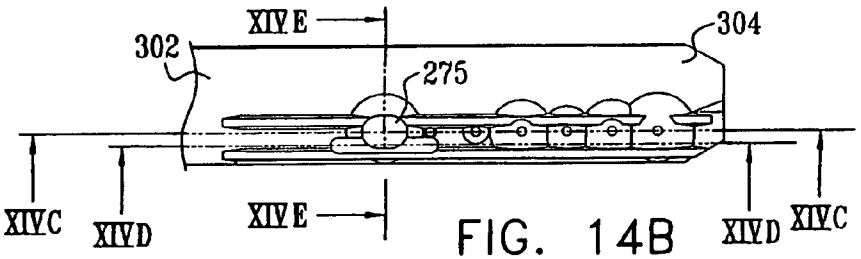
FIGS. 14A-14E are, respectively, a pictorial illustration, a plan view illustration and a plurality of sectional illustrations of the key produced from the partially key cut key blank of the type shown in FIGS. 12A-12E in operative engagement with the plug pin of FIGS. 10A-10F.
Figure 14C:
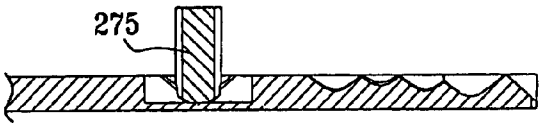
Figure 14D:
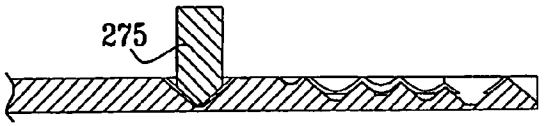
Figure 14E:
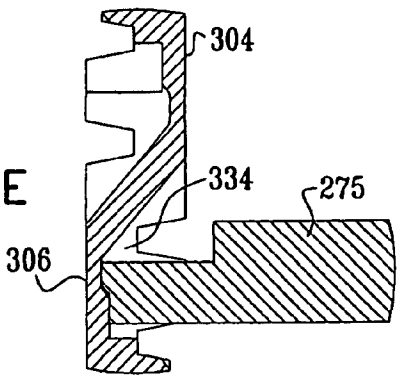
Figure 14A:
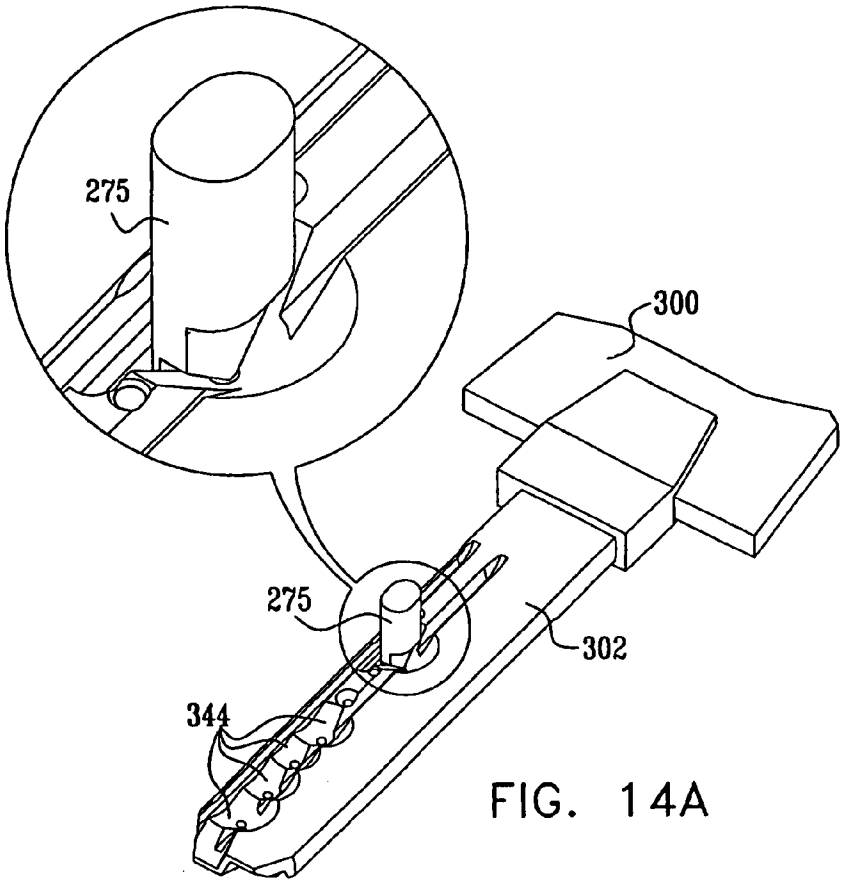
Figure 18B:
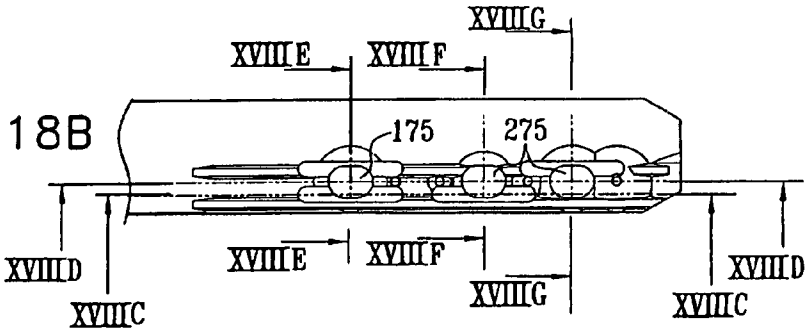
FIGS. 18A-18G are, respectively, a pictorial illustration, a plan view illustration and a plurality of sectional illustrations of the key produced from the partially key cut key blank of the type shown in FIGS. 16A-16G in operative engagement with plug pins of the types shown in FIGS. 5A-5F and 10A-10F.
Figure 18C:
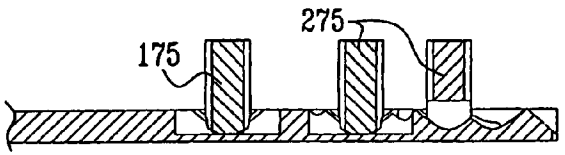
Figure 18D:
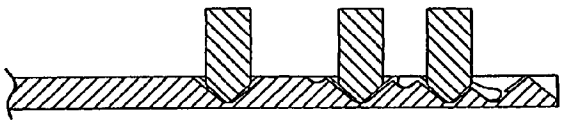
Figure 18G:
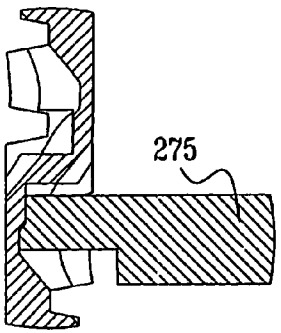
Figure 18F:
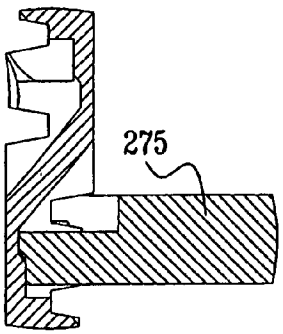
Figure 18E:
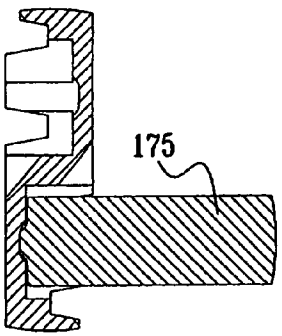
Figure 18A:
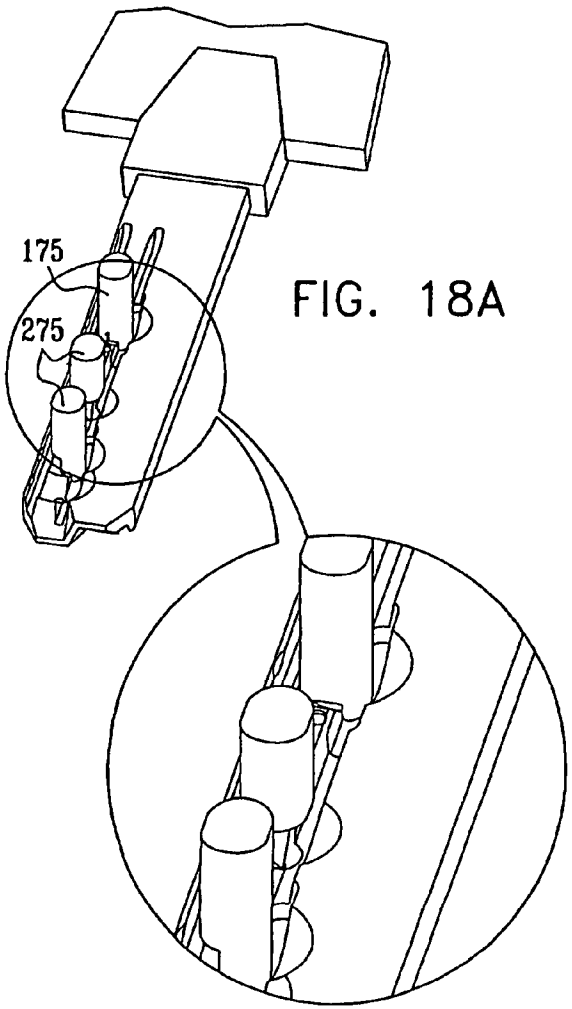
Figure 22B:
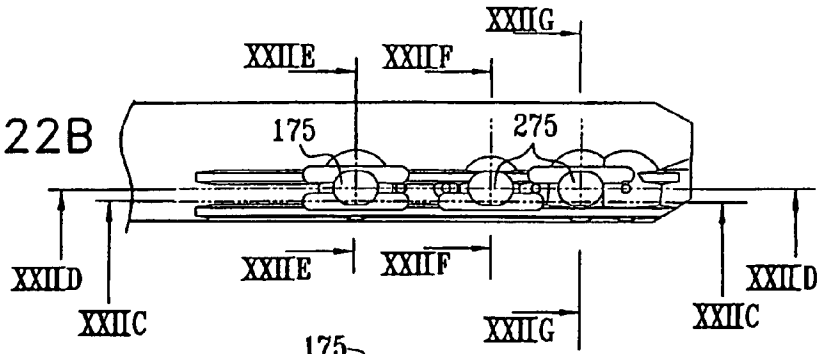
FIGS. 22A-22G are, respectively, a pictorial illustration, a plan view illustration and a plurality of sectional illustrations of the key produced from the partially key cut key blank of the type shown in FIGS. 20A-20G in operative engagement with plug pins of the types shown in FIGS. 5A-5F and 10A-10F.
Figure 22C:
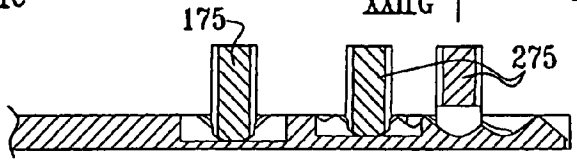
Figure 22D:
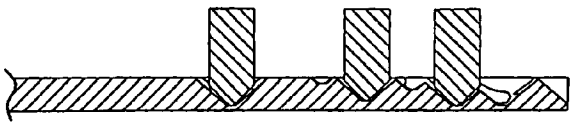
Figure 22G:
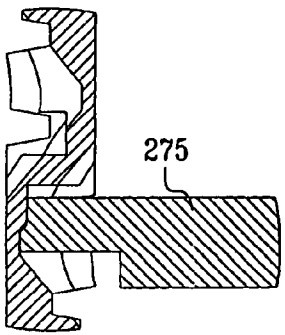
Figure 22F:
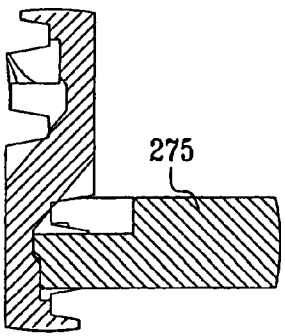
Figure 22E:
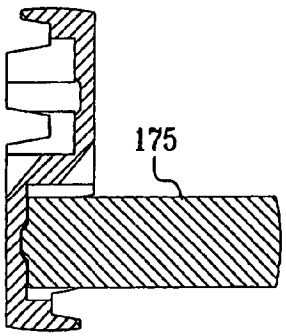
Figure 22A:
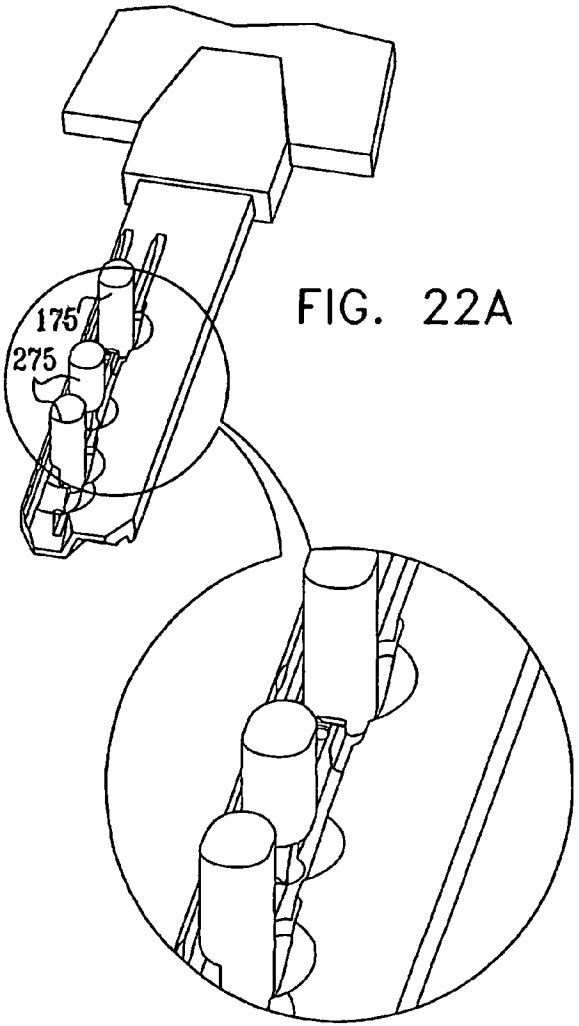

Reference is now made to FIGS. 10A-10F, which are six different illustrations of another preferred second plug pin 275, useful in the cylinders of FIGS. 1A-3B, which cooperates with a key of the type shown in FIGS. 11A and 11B. FIG. 10A is a pictorial illustration; FIG. 10B is a side view illustration, FIG. 10C is a sectional illustration taken along lines XC-XC in FIG. 10B; FIG. 10D is a side view illustration, FIG. 10E is a sectional illustration taken along lines XE-XE in FIG. 10D and FIG. 10F is a top view.

FIGS. 10A-10F illustrate a plug pin 275 having a generally oval cylindrical configuration defining a major axis 280 and a minor axis 282, it being appreciated that any overall configuration which does not allow rotation of the plug pin in the plug pin bore may alternatively be employed. The head of the plug pin is partially cut away, as indicated at reference numeral 283 and defines an elongate generally rectangular protrusion 284 which extends along the minor axis 282 and an inclined plane 286 extending downwardly from each side of protrusion 284; Extending downwardly from one end of protrusion 284 there is a first conical surface 288 which joins a second conical surface 290. An interrupted elongate protrusion 292 extends on both sides of the second conical surface 290.

Reference is now made to FIGS. 11A and 11B, which are, respectively, a plan view and sectional illustration of a key blank constructed and operative in accordance with another preferred embodiment of the present invention. As seen in FIGS. 11A and 11B, the key blank comprises a head portion 300 and a shank portion 302, preferably in the form of a flat blade having first and second oppositely-facing planar surfaces 304 and 306. Formed on each of planar surfaces 304 and 306 are a pair of guide grooves, respectively designated by reference numerals 308 & 310 and 312 and 314, which define a key-cut region on each surface. In accordance with a preferred embodiment of the invention an additional groove is formed at at least one key cut location in the key-cut region of each of planar surfaces 304 and 306. The additional grooves are designated by reference numerals 318 and 322 respectively.

It is a particular feature of the present invention that additional grooves 318 and 322 define part of the second key cuts referred to hereinabove and are absent from the first key cuts referred to hereinabove.

Key blanks configured generally as shown in FIGS. 11A and 11B may have additional grooves located selectably at different key cut locations, thereby to define second key cut locations. It is appreciated that by selective distribution of key blanks of the type shown in FIGS. 11A and 11B, having given second key cut locations, cutting of keys having corresponding second key cut locations may be correspondingly restricted.

Reference is now made to FIGS. 12A-12E, which are, respectively, a pictorial illustration, a plan view illustration and a plurality of sectional illustrations of a partially key cut key blank of the type shown in FIGS. 11A and 11B. The key blank of FIGS. 12A-12E is identical to that of FIGS. 11A and 11B and is formed with an additional key cut, having a generally truncated conical configuration, similar to that of a first key cut, over each additional groove, thus fully defining a second key cut on each of planar surfaces 304 and 306. The second key cut, which is a combination of the additional groove and the additional truncated conical key cut, is identified by reference numeral 334 on planar surface 304 and by reference numeral 336 on planar surface 306.

Key blanks configured generally as shown in FIGS. 12A-12E may have second key cuts located selectably at different key cut locations, thereby to define second key cut locations. It is appreciated that by selective distribution of key blanks of the type shown in FIGS. 12A-12E, having given second key cut locations, cutting of keys having corresponding second key cut locations may be correspondingly restricted.

Reference is now made to FIGS. 13A-13E, which are, respectively, a pictorial illustration, a plan view illustration and a plurality of sectional illustrations of a key produced from the partially key cut key blank of the type shown in FIGS. 12A-12E. The difference between the key of FIGS. 13A-13E and the key blank of FIGS. 12A-12E is in the addition of first key cuts at additional locations along the key cut region on each of planar surfaces 304 and 306. The additional key cuts are indicated generally by reference numeral 344 on planar surface 304 and are not shown on planar surface 306.

Reference is now made to FIGS. 14A-14E, which are, respectively, a pictorial illustration, a plan view illustration and a plurality of sectional illustrations of the key produced from the partially key cut key blank of the type shown in FIGS. 12A-12E in operative engagement with the plug pin of FIGS. 10A-10F. FIGS. 14A-14E illustrate engagement of plug pin 275 (FIGS. 10A-10E) with second key cut 334. It is seen that due to the provision of additional groove 318 (FIGS. 11A and 11B) in the second key cut 334, the pin 275 is enabled to seat fully in the second key cut. It is appreciated that pin 275 could not seat fully in a first key cut. Accordingly keys which do not include suitably placed second key cuts cannot operate the non-conventional cylinders of the type described herein.

Reference is now made to FIGS. 15A-15D, which are, respectively, a plan view and a plurality of sectional illustrations of a key blank constructed and operative in accordance with yet another preferred embodiment of the present invention. As seen in FIGS. 15A-15D, the key blank comprises a head portion 400 and a shank portion 402, preferably in the form of a flat blade having first and second oppositely-facing planar surfaces 404 and 406. Formed on each of planar surfaces 404 and 406 are a pair of guide grooves, respectively designated by reference numerals 408 & 410 and 412 and 414, which define a key-cut region on each surface. In accordance with a preferred embodiment of the invention a plurality of pairs of additional grooves are formed at a plurality of key cut locations in the key-cut region of each of planar surfaces 404 and 406. These additional grooves are designated by reference numerals 417, 418, 419 & 420 and 421, 422, 423 and 424 respectively.

It is a particular feature of the present invention that additional grooves 417-424 define part of the second key cuts referred to hereinabove and are absent from the first key cuts referred to hereinabove.

Key blanks configured generally as shown in FIGS. 15A-15D may have one or more grooves located selectably at different key cut locations, thereby to define second key cut locations. It is appreciated that by selective distribution of key blanks of the type shown in FIGS. 15A-15D, having given second key cut locations, cutting of keys having corresponding second key cut locations may be correspondingly restricted.

Reference is now made to FIGS. 16A-16G, which are, respectively, a pictorial illustration, a plan view illustration and a plurality of sectional illustrations of a partially key cut key blank of the type shown in FIGS. 15A-15D. The key blank of FIGS. 16A-16G is identical to that of FIGS. 15A-15D and is formed with additional key cuts, each having a generally truncated conical configuration, similar to that of a first key cut, over each pair of additional grooves, thus fully defining second key cuts on each of planar surfaces 404 and 406. The second key cuts, which are each a combination of a pair of additional grooves and the additional truncated conical key cut, are identified by reference numeral 434 on planar surface 404 and by reference numeral 435 on planar surface 406. Additional second key cuts which are each a combination of an additional groove and an additional truncated conical key cut are identified by reference numerals 436 & 437 on planar surface 404 and by reference numerals 438 & 439 on planar surface 406.

Key blanks configured generally as shown in FIGS. 16A-16G may have second key cuts located selectably at different key cut locations, thereby to define second key cut locations. It is appreciated that by selective distribution of key blanks of the type shown in FIGS. 16A-16G, having given second key cut locations, cutting of keys having corresponding second key cut locations may be correspondingly restricted.

Reference is now made to FIGS. 17A-17G, which are, respectively, a pictorial illustration, a plan view illustration and a plurality of sectional illustrations of a key produced from the partially key cut key blank of the type shown in FIGS. 16A-16G. The difference between the key of FIGS. 17A-17G and the key blank of FIGS. 16A-16G is in the addition of first key cuts at additional locations along the key cut region on each of planar surfaces 404 and 406. The additional key cuts are indicated generally by reference numeral 444 on planar surface 404 and are not shown on planar surface 406.

Reference is now made to FIGS. 18A-18G, which are, respectively, a pictorial illustration, a plan view illustration and a plurality of sectional illustrations of the key produced from the partially key cut key blank of the type shown in FIGS. 16A-16G in operative engagement with plug pins of FIGS. 5A-5F and of FIGS. 10A-10F. FIGS. 18A-18G illustrate engagement of a plug pin 175 (FIGS. 5A-5E) with second key cut 434 and engagement of plug pins 275 (FIGS. 10A-10F) with second key cuts 436 & 437. It is seen that due to the provision of additional grooves in the second key cuts, which accommodate elongate protrusions 192 and 194 (FIGS. 5A-5E) and elongate protrusion 292 (FIGS. 10A-10E), the pins 175 and 275 are enabled to seat fully in the second key cuts. It is appreciated that pins 175 and 275 could not seat fully in a first key cut. Accordingly keys which do not include suitably placed second key cuts cannot operate the non-conventional cylinders of the type described herein.

Reference is now made to FIGS. 19A-19D, which are, respectively, a plan view and a plurality of sectional illustrations of a key blank constructed and operative in accordance with still another preferred embodiment of the present invention. As seen in FIGS. 19A-19D, the key blank comprises a head portion 500 and a shank portion 502, preferably in the form of a flat blade having first and second oppositely-facing planar surfaces 504 and 506. Formed on each of planar surfaces 504 and 506 are a pair of guide grooves, respectively designated by reference numerals 508 & 510 and 512 and 514, which define a key-cut region on each surface. In accordance with a preferred embodiment of the invention a plurality of pairs of additional grooves are formed at a plurality of key cut locations in the key-cut region of each of planar surfaces 504 and 506. These additional grooves are designated by reference numerals 517, 518, 519 & 520 and 521, 522, 523 and 524 respectively and are shown to have differing depths.

It is a particular feature of the present invention that additional grooves 517-524 define part of the second key cuts referred to hereinabove and are absent from the first key cuts referred to hereinabove.

Key blanks configured generally as shown in FIGS. 19A-19D may have one or more grooves located selectably at different key cut locations, thereby to define second key cut locations. It is appreciated that by selective distribution of key blanks of the type shown in FIGS. 19A-19D, having given second key cut locations, cutting of keys having corresponding second key cut locations may be correspondingly restricted. The provision of different depths of the grooves provides a facility suitable for use in mastering keys.

Reference is now made to FIGS. 20A-20G, which are, respectively, a pictorial illustration, a plan view illustration and a plurality of sectional illustrations of a partially key cut key blank of the type shown in FIGS. 19A-19D. The key blank of FIGS. 20A-20G is identical to that of FIGS. 19A-19D and is formed with additional key cuts, each having a generally truncated conical configuration, similar to that of a first key cut, over each pair of additional grooves, thus fully defining second key cuts on each of planar surfaces 504 and 506. The second key cuts, which are each a combination of a pair of additional grooves and the additional truncated conical key cut, are identified by reference numeral 534 on planar surface 504 and by reference numeral 535 on planar surface 506. Additional second key cuts which are each a combination of an additional groove and an additional truncated conical key cut are identified by reference numerals 536 & 537 on planar surface 504 and by reference numerals 538 & 539 on planar surface 506.

Key blanks configured generally as shown in FIGS. 20A-20G may have second key cuts located selectably at different key cut locations, thereby to define second key cut locations. It is appreciated that by selective distribution of key blanks of the type shown in FIGS. 20A-20G, having given second key cut locations, cutting of keys having corresponding second key cut locations may be correspondingly restricted. The provision of different depths of the grooves provides a facility suitable for use in mastering keys.

Reference is now made to FIGS. 21A-21G, which are, respectively, a pictorial illustration, a plan view illustration and a plurality of sectional illustrations of a key produced from the partially key cut key blank of the type shown in FIGS. 20A-20G. The difference between the key of FIGS. 21A-21G and the key blank of FIGS. 20A-20G is in the addition of first key cuts at additional locations along the key cut region on each of planar surfaces 504 and 506. The additional key cuts are indicated generally by reference numeral 544 on planar surface 504 and are not shown on planar surface 506.

Reference is now made to FIGS. 22A-22G, which are, respectively, a pictorial illustration, a plan view illustration and a plurality of sectional illustrations of the key produced from the partially key cut key blank of the type shown in FIGS. 20A-20G in operative engagement with plug pins of FIGS. 5A-5F and of FIGS. 10A-10F. FIGS. 22A-22G illustrate engagement of a plug pin 175 (FIGS. 5A-5F) with second key cut 534 and engagement of plug pins 275 (FIGS. 10A-10F) with second key cuts 536 & 537. It is seen that due to the provision of additional grooves in the second key cuts, which accommodate elongate protrusions 192 and 194 (FIGS. 5A-5F) and 292 (FIGS. 10A-10F) the pins 175 and 275 are enabled to seat fully in the second key cuts. It is appreciated that pins 175 and 275 could not seat fully in a first key cut. Accordingly keys which do not include suitably placed second key cuts cannot operate the non-conventional cylinders of the type described herein.

Figure 23B:
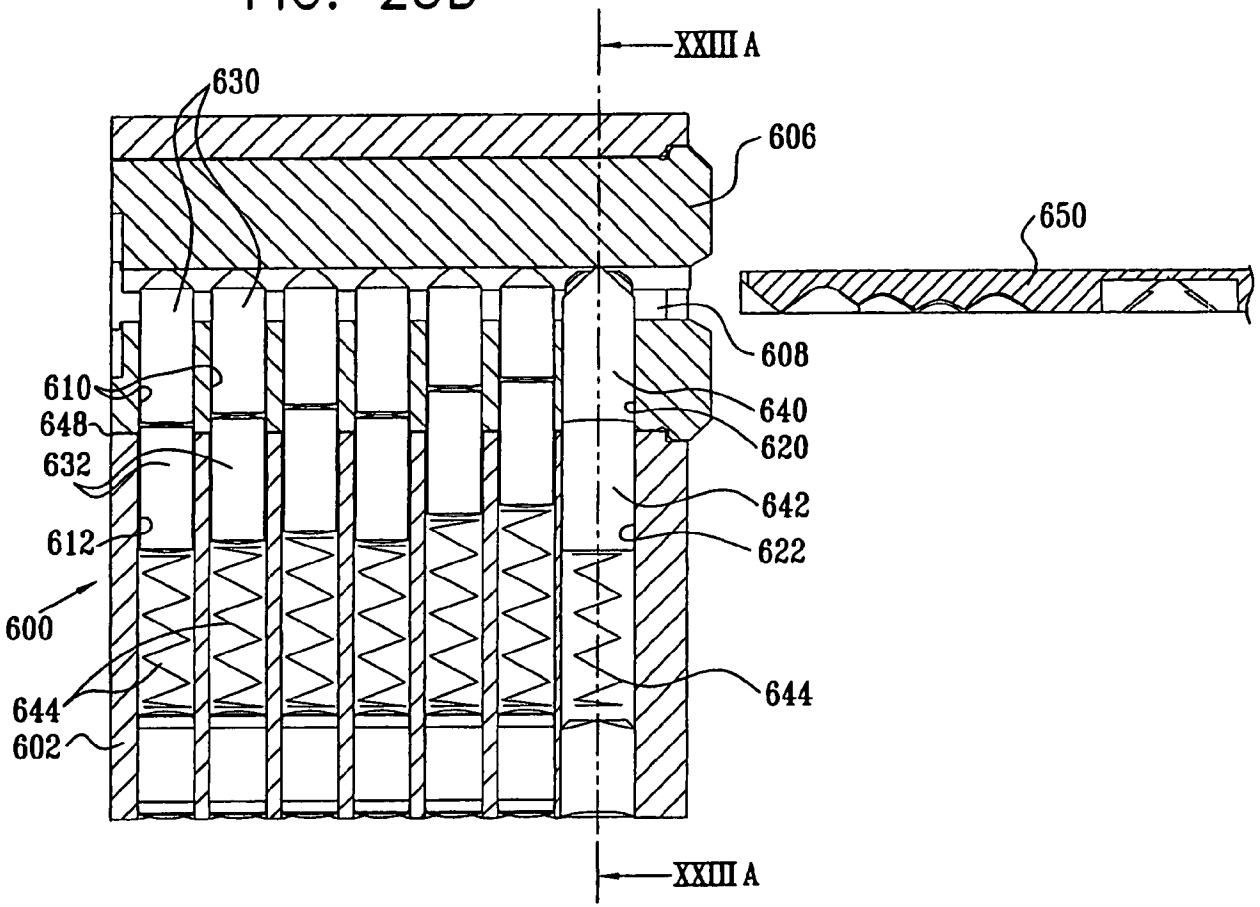
FIGS. 23A and 23B are sectional illustrations of a key-operated lock cylinder and key constructed and operative in accordance with another preferred embodiment of the invention, in a locked orientation.
Figure 23A:
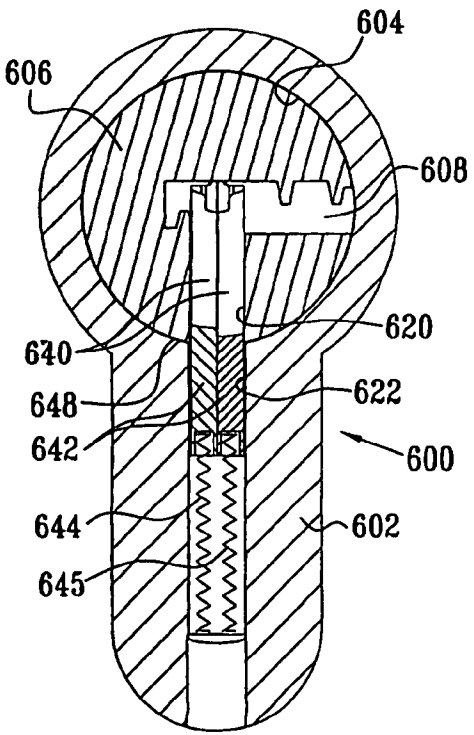

Reference is now made to FIGS. 23A and 23B, which are sectional illustrations of a key-operated lock cylinder and key, constructed and operative in accordance with another preferred embodiment of the invention, in a locked orientation. As seen in FIGS. 23A & 23B, the cylinder, here designated generally by reference numeral 600, includes a cylinder body 602 defining a bore 604. A plug 606 is rotatably disposed within bore 604 in cylinder body 602 and defines a keyway 608 and first cylindrical plug pin bores 610 communicating therewith and with corresponding first cylindrical body pin bores 612 formed in cylinder body 602.

In accordance with a preferred embodiment of the present invention, there is also provided at least one second cylindrical plug pin bore 620 communicating with keyway 608 and with at least one corresponding second cylindrical body pin bore 622 formed in cylinder body 602. Second pin bores 620 and 622 are generally distinguished from first pin bores 610 and 612 in that whereas first pin bores 610 and 612 generally have a conventional circular cylindrical configuration, second pin bores 620 and 622 typically have a non-circular cylindrical configuration, such as an oval cylindrical configuration in the illustrated embodiment.

First multi-part plug pins 630 and first multi-part body pins 632 are operatively disposed in respective first plug pin bores 610 and first body pin bores 612. Second multi-part plug pin 640 and second multi-part body pin 642 are operatively disposed in respective second plug pin bore 620 and second body pin bore 622. Springs 644 and 645 are operatively associated with the multi-part body pins 632 and 642 in a conventional manner.

Second multi-part body pins 642 are generally distinguished from first multi-part body pins 632 in that whereas first multi-part body pins 632 generally have a conventional circular cylindrical configuration, second multi-part body pins 642 typically have a non-circular cylindrical configuration, such as an oval cylindrical configuration in the illustrated embodiment.

Second multi-part plug pins 640 are generally distinguished from first multi-part plug pins 630 in that whereas first multi-part plug pins 630 generally have a conventional circular cylindrical configuration, second multi-part plug pins 640 typically have a non-circular cylindrical configuration, such as an oval cylindrical configuration in the illustrated embodiment. Second multi-part plug pins 640 are also generally distinguished from first multi-part plug pins 630 in that whereas first multi-part plug pins 630 generally have a conventional circularly symmetric, conical pin head configuration, second multi-part plug pins 640 have a non-circularly symmetric head configuration, such as that shown in detail in FIGS. 27A-27F.

The first and second multi-part plug pins 630 and 640 communicate with keyway 608 and are selectably positionable by key cuts on a key when inserted into the keyway with respect to a shear line 648 between the cylinder body 610 and the plug 606 to permit rotation of the plug 606 with respect to the cylinder body 600. In FIGS. 23A and 23B, the key, here designated by reference numeral 650, is not inserted into the keyway 608 and thus the various multi-part plug and body pins are not aligned so as to be separated from each other along the shear line 648.

Figure 24B:
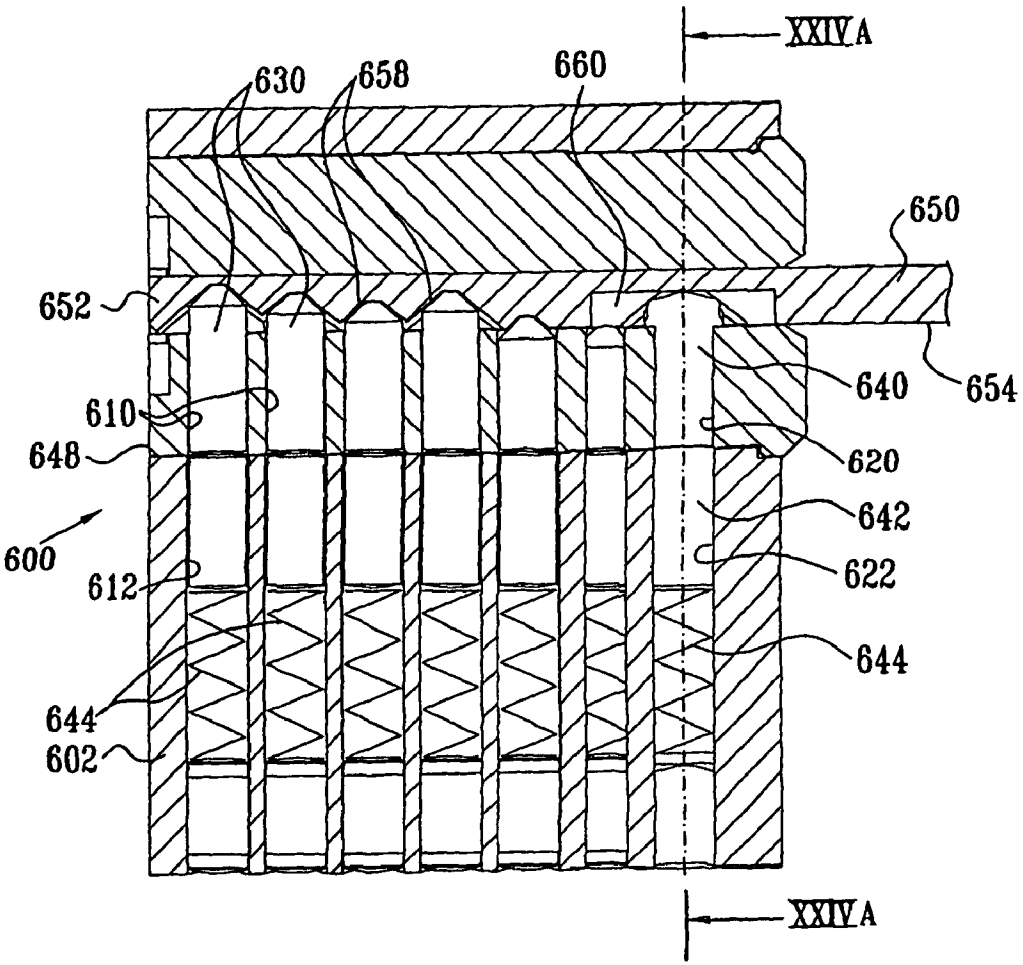
FIGS. 24A & 24B are sectional illustrations of the key-operated lock cylinder and key of FIGS. 23A and 23B in an open orientation.
Figure 24A:
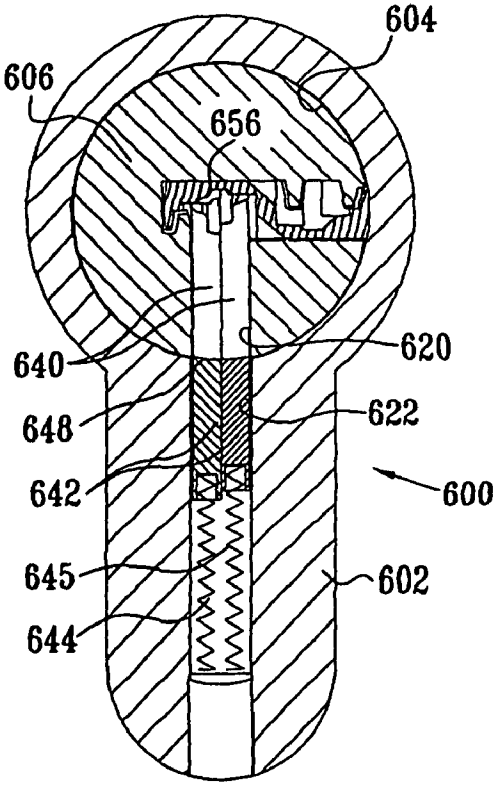

Reference is now made to FIGS. 24A and 24B, which illustrates the key-operated lock cylinder and key of FIGS. 23A and 23B in an open orientation, where key 650 is fully inserted into the keyway 608.

As seen in FIGS. 24A and 24B, key 650 includes a shank 652 defining at least one planar surface 654 configured to define a longitudinally extending key-cut region 656 thereon. The longitudinally extending region 656 has formed thereon a plurality of conventional, generally conical first key cuts 658 configured to position the engagement between the first multi-part plug pins 630 and the first multi-part body pins 632 at the shear line 648 and has at least partially pre-formed thereon at least one second key cut 660 configured in a non-conical, non-circularly symmetric configuration to position corresponding at least one second multi-part plug pin 640 and at least one second multi-part body pin 642 at shear line 648, as shown.

Figure 25B:
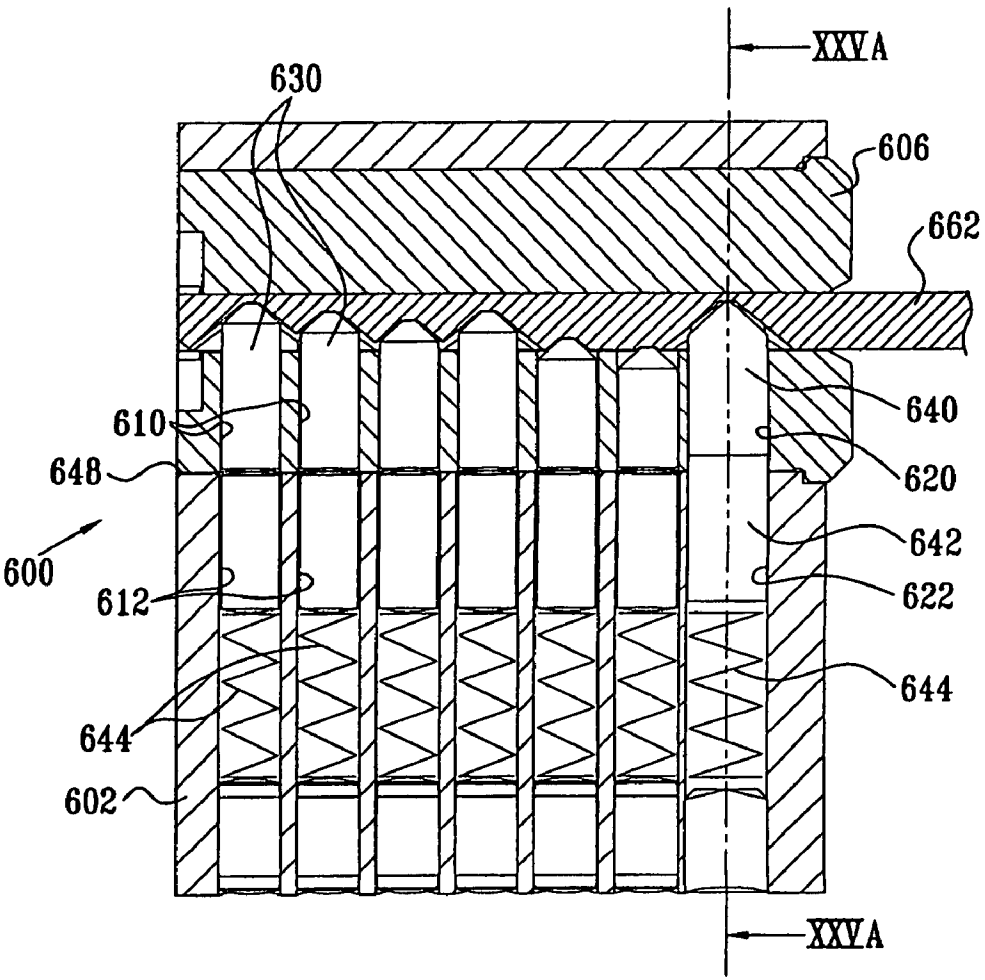
FIGS. 25A & 25B are sectional illustrations of the key-operated lock cylinder of FIGS. 23A-24B in a locked orientation with a conventional key inserted therein.
Figure 25A:
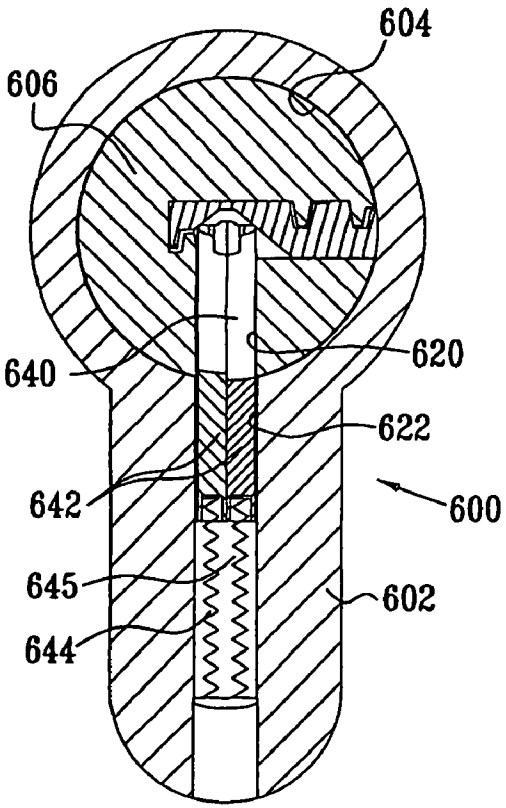

Reference is now made to FIGS. 25A & 25B, which are sectional illustrations of the key-operated lock cylinder of FIGS. 23A-23B in a locked orientation with a conventional key 662 inserted therein. It is seen that the conventional key does not include second key cuts and thus does not position the engagement of second plug pin 640 and second body pin 642 at shear line 648, as shown.

Figures 27A, 27B, 27C, 27D, 27E, 27F:
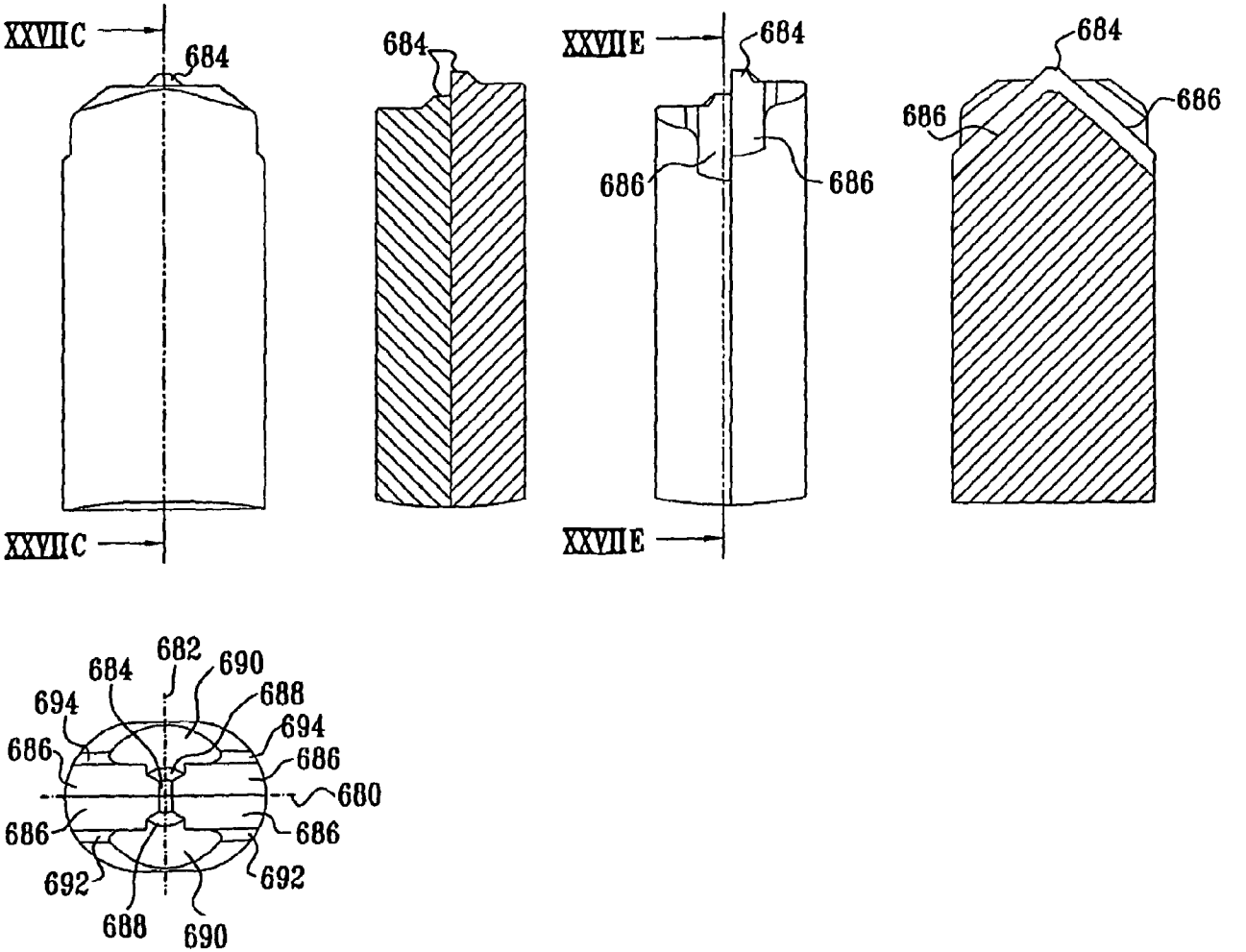
FIGS. 27A-27F are six different illustrations of a multipart cylinder plug pin employing parts of the type shown in FIGS. 26A-26F, useful in the cylinders of FIGS. 23A-25B which cooperates with a key of the type shown in FIGS. 23A-24B.

Reference is now made to FIGS. 26A-26F, which are six different illustrations of one part of a preferred second multi-part plug pin 675 useful in the cylinders of FIGS. 23A-25B which cooperates with a key of the type shown in FIGS. 23A-24B. FIG. 26A is a pictorial illustration; FIG. 26B is a side view illustration. FIG. 26C is a sectional illustration taken along lines XXVIC-XXVIC in FIG. 26B; FIG. 26D is a side view illustration, FIG. 26E is a sectional illustration taken along lines XXVIE-XXVIE in FIG. 26D and FIG. 26F is a top view. Reference is also made to FIGS. 27A-27F, which are six different illustrations of a preferred second multi-part plug pin 675 formed of two parts of the type shown in FIGS. 26A-26F, which is useful in the cylinders of FIGS. 23A-25B and cooperates with a key of the type shown in FIGS. 23A-24B. FIG. 27A is a pictorial illustration; FIG. 27B is a side view illustration, FIG. 27C is a sectional illustration taken along lines XXVIIC-XXVIIC in FIG. 27B; FIG. 27D is a side view illustration, FIG. 27E is a sectional illustration taken along lines XXVIIE-XXVIIE in FIG. 27D and FIG. 27F is a top view.

FIGS. 26A-27F illustrate a plug pin formed of two parts, which together have a generally oval cylindrical configuration defining a major axis 680 and a minor axis 682, it being appreciated that any overall configuration which does not allow rotation of the plug pin in the plug pin bore may alternatively be employed. The head of the plug pin defines a two-part elongate generally rectangular protrusion 684 which extends along the minor axis 682 and an inclined plane 686 extending downwardly from each side of protrusion 684. Extending downwardly from each end of protrusion 684 there is a first conical surface 688 which joins a second conical surface 690. First and second interrupted elongate protrusions 692 and 694 extend on both sides of the respective second conical surfaces 690.

Figure 28B:
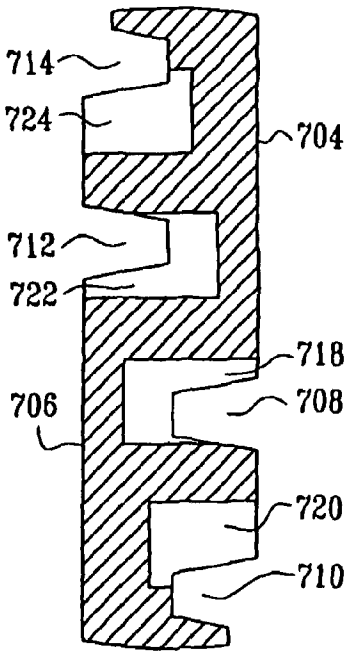
FIGS. 28A and 28B are, respectively, a plan view and sectional illustration of a key blank constructed and operative in accordance with a preferred embodiment of the present invention.
Figure 28A:
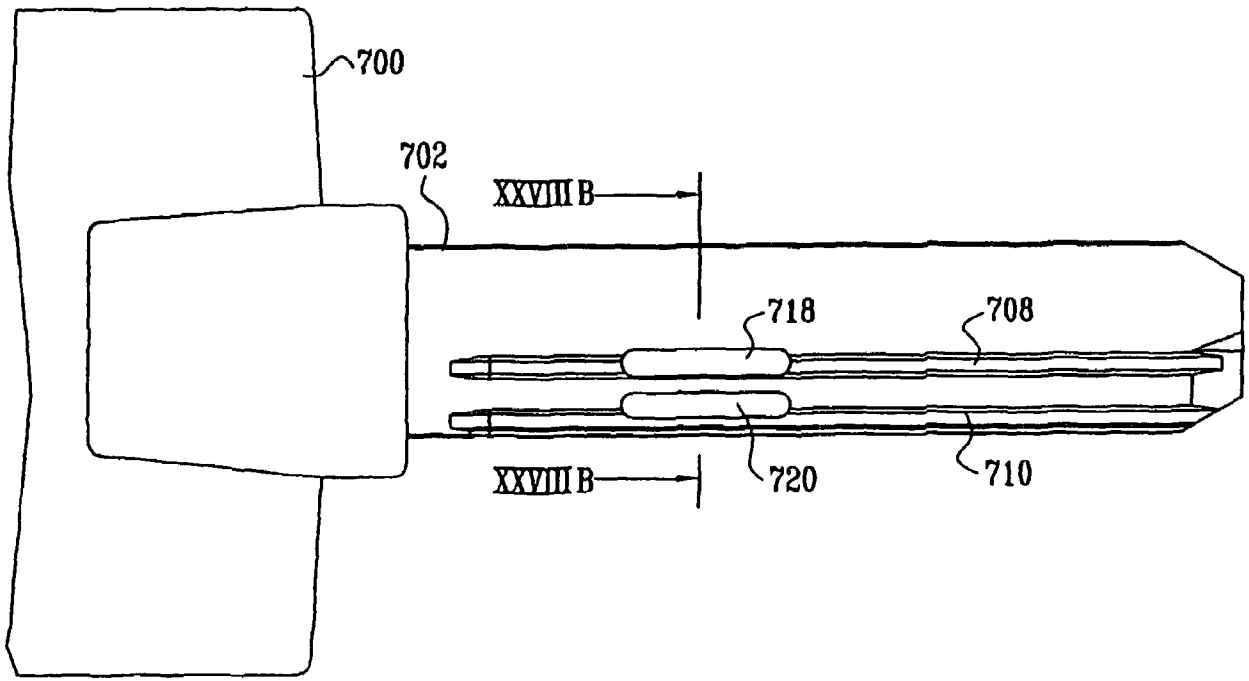

Reference is now made to FIGS. 28A and 28B, which are, respectively, a plan view and sectional illustration of a key blank constructed and operative in accordance with a preferred embodiment of the present invention. As seen in FIGS. 28A and 28B, the key blank comprises a head portion 700 and a shank portion 702, preferably in the form of a flat blade having first and second oppositely-facing planar surfaces 704 and 706. Formed on each of planar surfaces 704 and 706 are a pair of guide grooves, respectively designated by reference numerals 708 & 710 and 712 and 714, which define a key-cut region on each surface. In accordance with a preferred embodiment of the invention a pair of additional grooves are formed at at least one key cut location in the key-cut region of each of planar surfaces 704 and 706. These additional grooves are designated by reference numerals 718 & 720 and 722 and 724 respectively.

It is a particular feature of the present invention that additional grooves 718-724 define part of the second key cuts referred to hereinabove and are absent from the first key cuts referred to hereinabove. It is a particular feature of the embodiment of FIGS. 23A-35F, that where the parts of the multi-part pins are of different lengths, as shown in FIGS. 27A-27F, the depths of the additional grooves 718-724 must be correspondingly different. It is appreciated that multi-part pins of equal length and key blanks with additional grooves of corresponding equal depths may also be provided.

Key blanks configured generally as shown in FIGS. 28A and 28B may have additional grooves located selectably at different key cut locations, thereby to define second key cut locations. It is appreciated that by selective distribution of key blanks of the type shown in FIGS. 28A and 28B, having given second key cut locations, cutting of keys having corresponding second key cut locations may be correspondingly restricted.

Reference is now made to FIGS. 29A-29E, which are, respectively, a pictorial illustration, a plan view illustration and a plurality of sectional illustrations of a partially key cut key blank of the type shown in FIGS. 28A and 28B. The key blank of FIGS. 29A-29E is identical to that of FIGS. 28A and 28B and is formed with an additional key cut, having a generally truncated conical configuration, similar to that of a first key cut, over each pair of additional grooves, thus fully defining a second key cut on each of planar surfaces 704 and 706. The second key cut, which is a combination of the additional grooves and the additional truncated conical key cut, is identified by reference numeral 734 on planar surface 704 and by reference numeral 736 on planar surface 706.

Key blanks configured generally as shown in FIGS. 29A-29E may have second key cuts located selectably at different key cut locations, thereby to define second key cut locations. It is appreciated that by selective distribution of key blanks of the type shown in FIGS. 29A-29E, having given second key cut locations, cutting of keys having corresponding second key cut locations may be correspondingly restricted.

Reference is now made to FIGS. 30A-30E, which are, respectively, a pictorial illustration, a plan view illustration and a plurality of sectional illustrations of a key produced from the partially key cut key blank of the type shown in FIGS. 29A-29E. The difference between the key of FIGS. 30A-30E and the key blank of FIGS. 29A-29E is in the addition of first key cuts at additional locations along the key cut region on each of planar surfaces 704 and 706. The additional key cuts are indicated generally by reference numeral 744 on planar surface 704 and are not shown on planar surface 706.

Figure 29B:
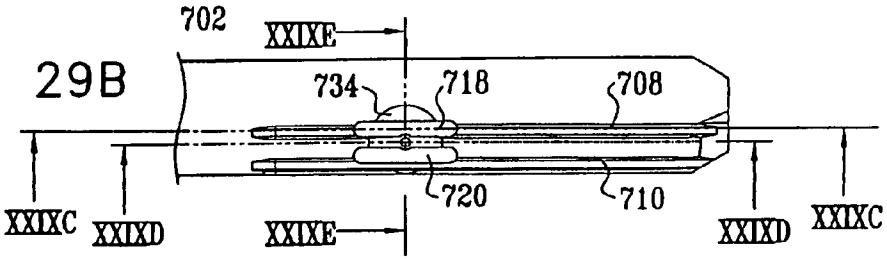
FIGS. 29A-29E are, respectively, a pictorial illustration, a plan view illustration and a plurality of sectional illustrations of a partially key cut key blank of the type shown in FIGS. 28A and 28B.
Figure 29C:
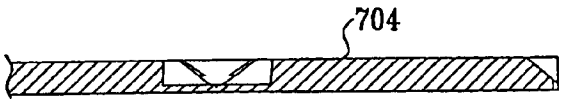
Figure 29D:
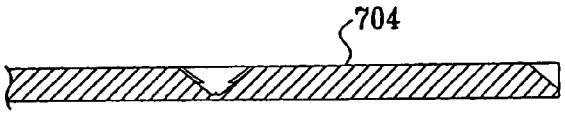
Figure 29E:
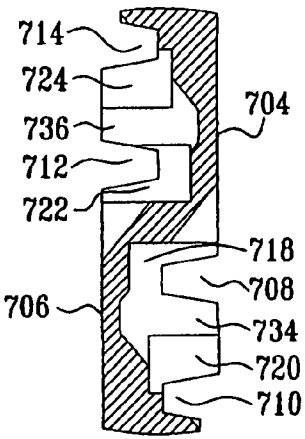
Figure 29A:
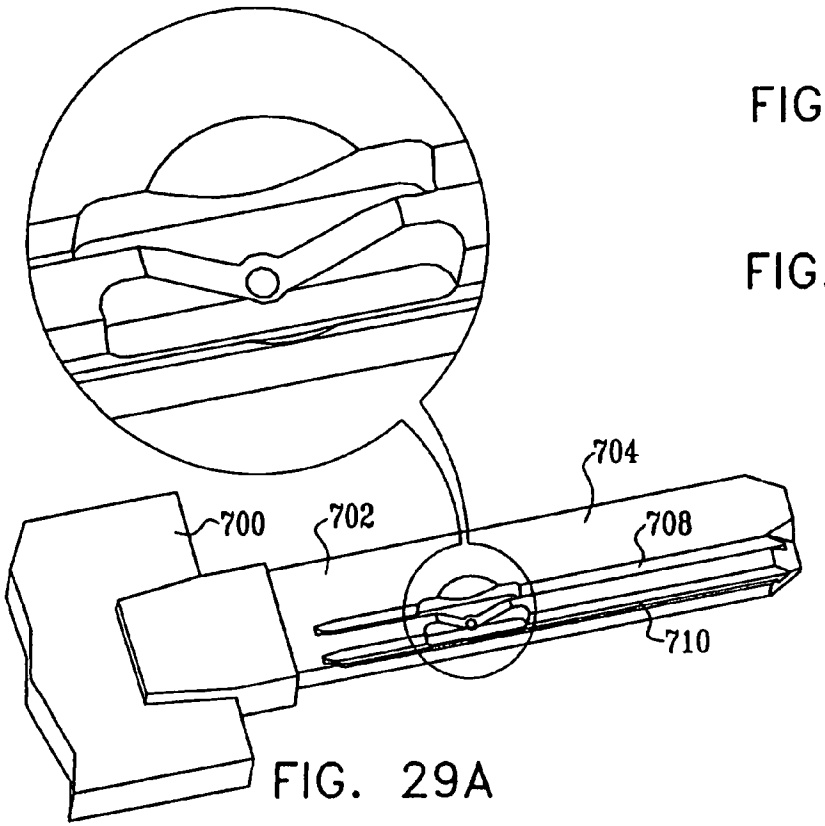
Figure 30B:
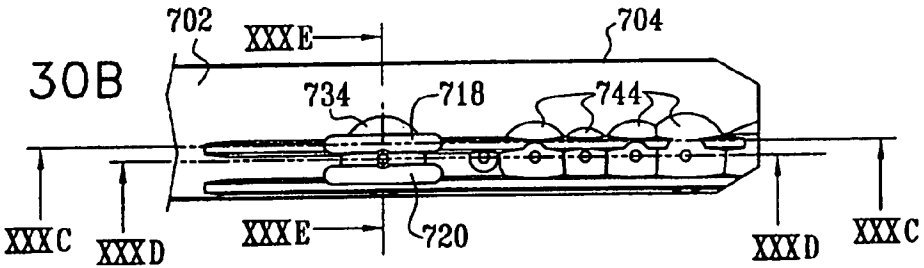
FIGS. 30A-30E are, respectively, a pictorial illustration, a plan view illustration and a plurality of sectional illustrations of a key produced from the partially key cut key blank of the type shown in FIGS. 29A-29E.
Figure 30C:
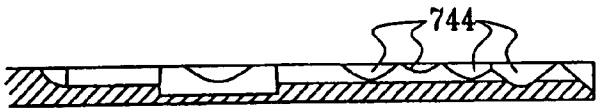
Figure 30D:
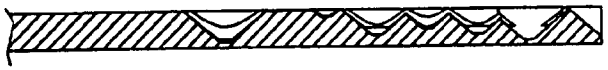
Figure 30E:
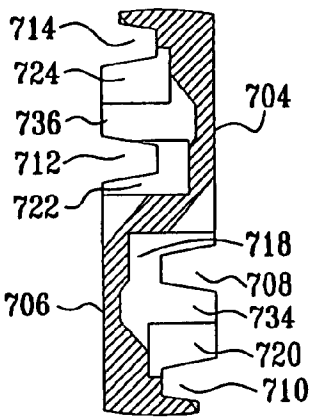
Figure 30A:
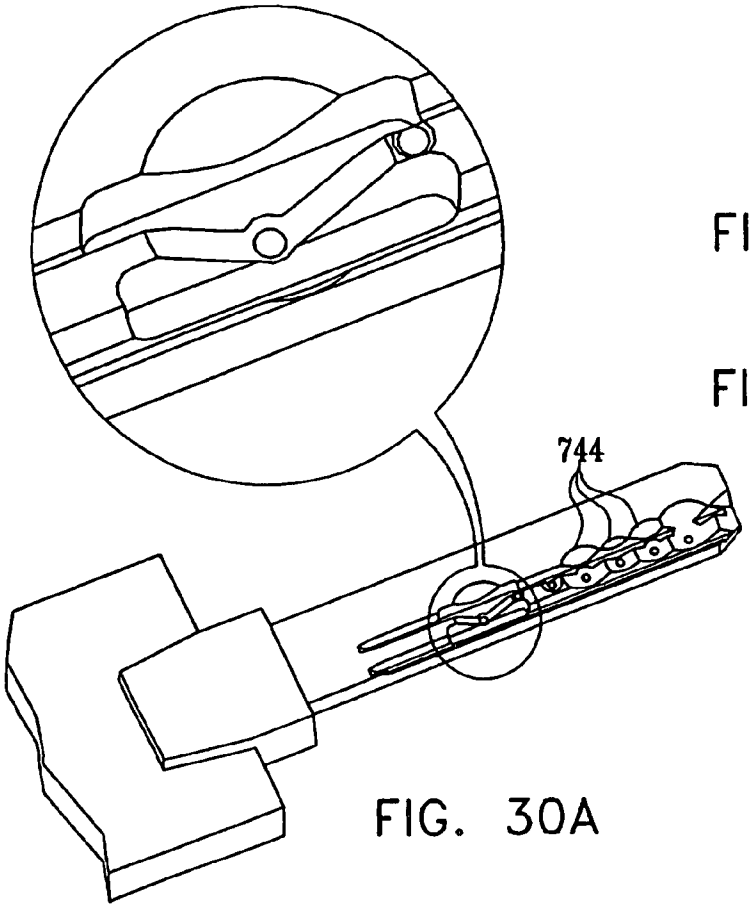
Figure 31B:
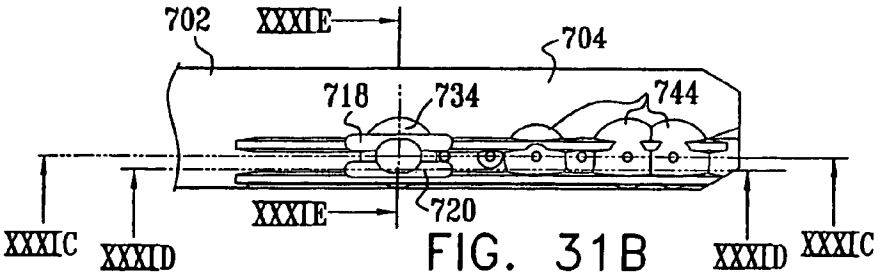
FIGS. 31A-31E are, respectively, a pictorial illustration, a plan view illustration and a plurality of sectional illustrations of the key produced from the partially key cut key blank of the type shown in FIGS. 29A-29E in operative engagement with the plug pin of FIGS. 27A-27F.
Figure 31C:
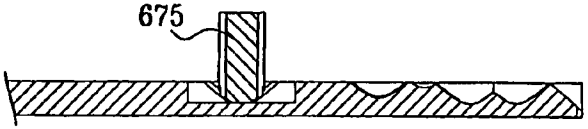
Figure 31D:
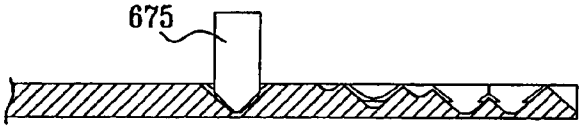
Figure 31E:
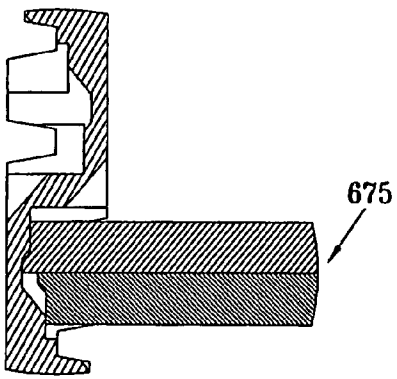
Figure 31A:
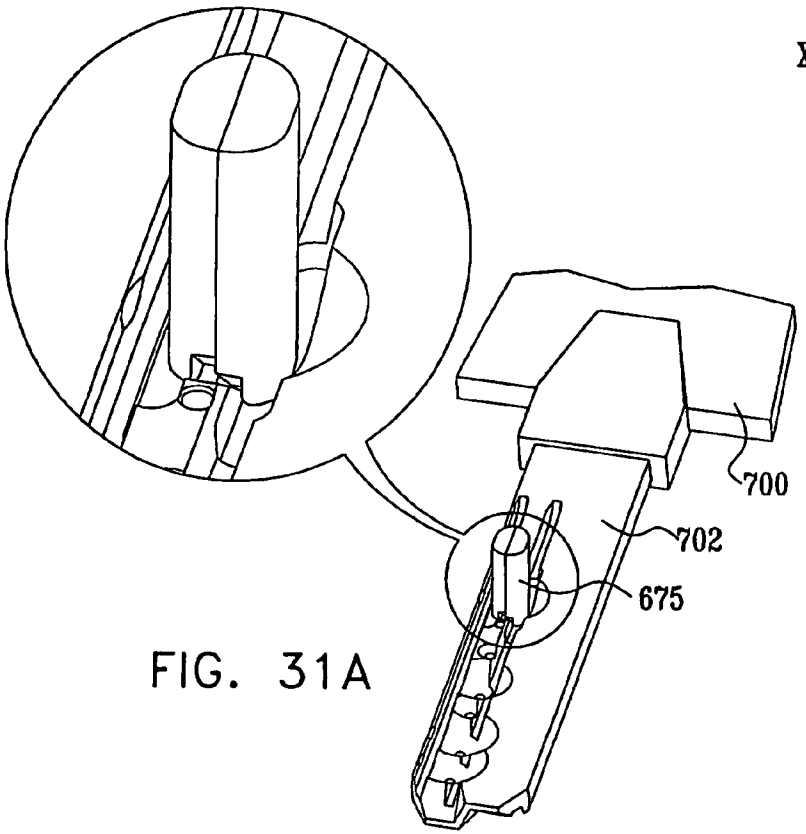
Figure 32A:
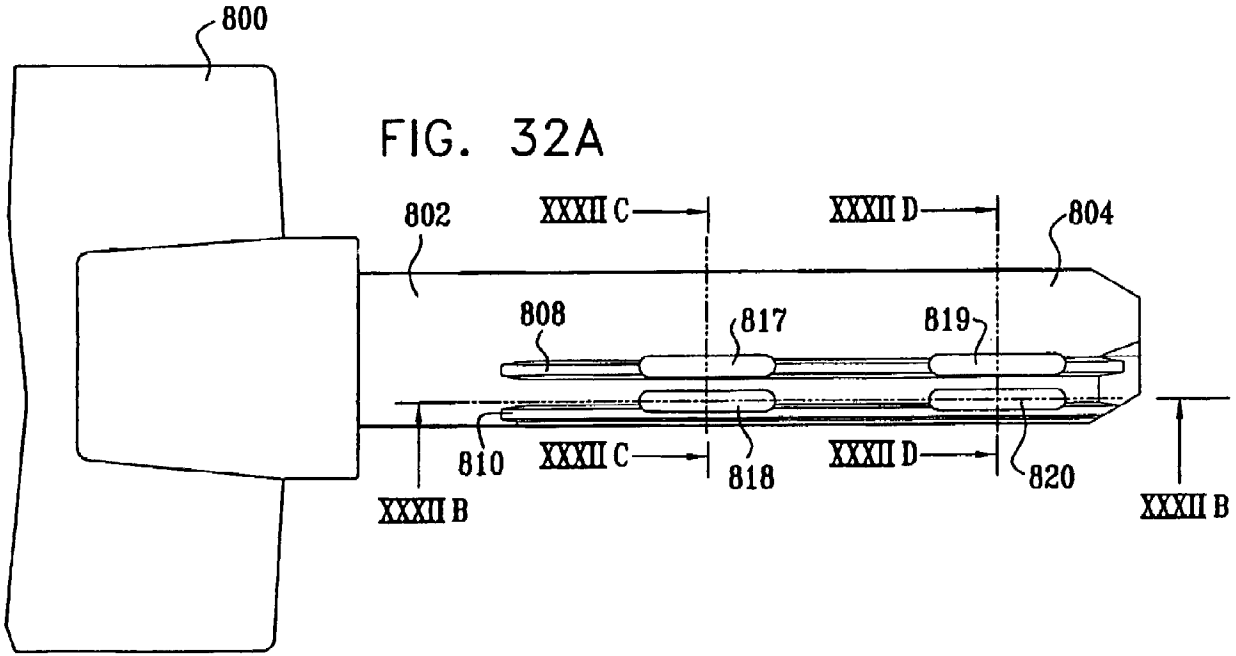
FIGS. 32A-32D are, respectively, a plan view and sectional illustrations of a key blank constructed and operative in accordance with still another preferred embodiment of the present invention.
Figure 32B:
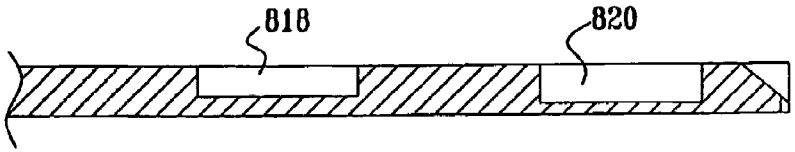
Figure 32C:
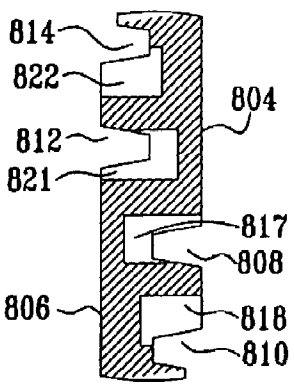
Figure 32D:
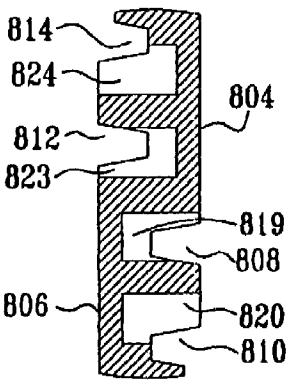
Figure 33B:
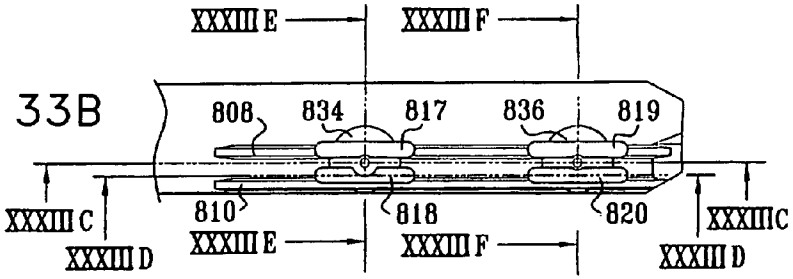
FIGS. 33A-33F are, respectively, a pictorial illustration, a plan view illustration and a plurality of sectional illustrations of a partially key cut key blank of the type shown in FIGS. 32A-32D.
Figure 33C:
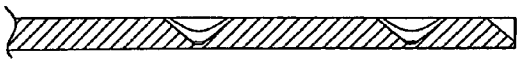
Figure 33D:
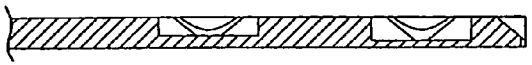
Figure 33F:
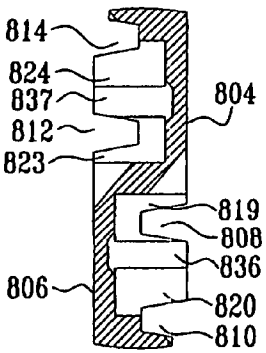
Figure 33E:
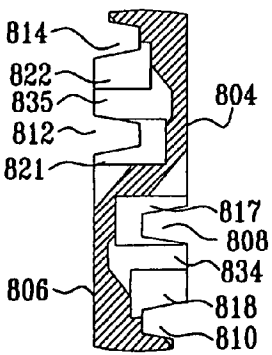
Figure 33A:
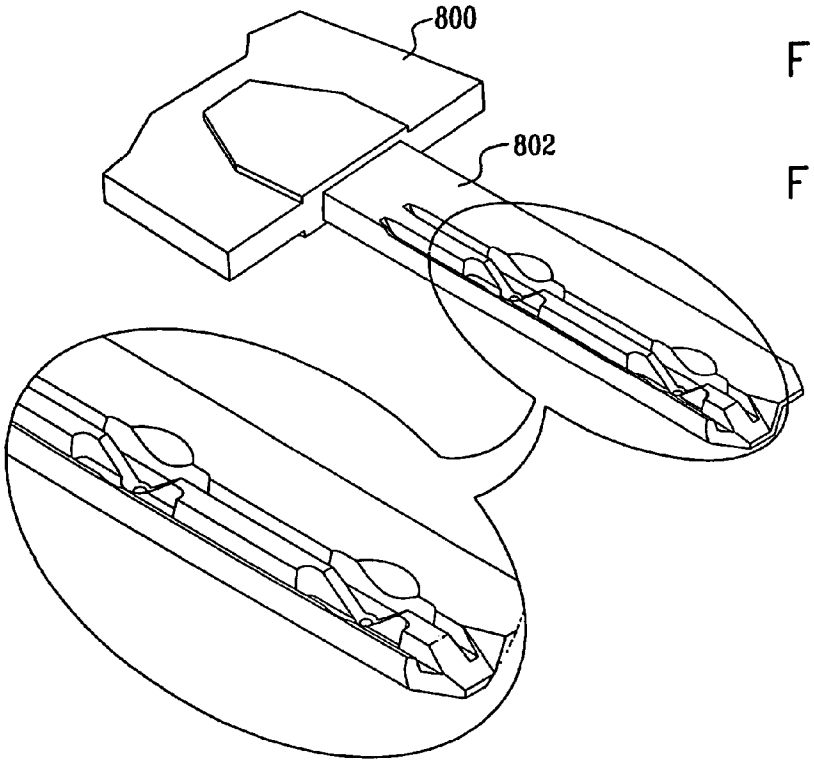
Figure 35B:
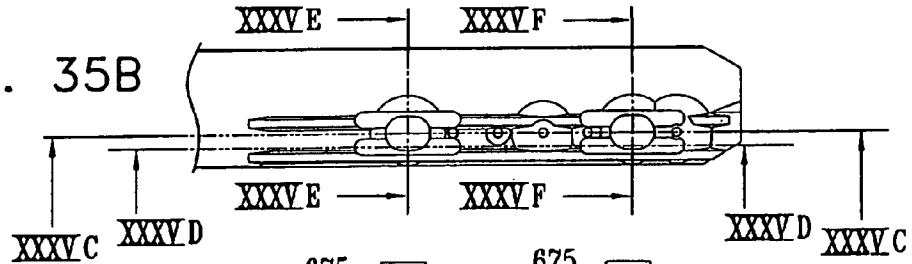
Figure 35C:
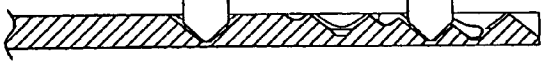
Figure 35D:
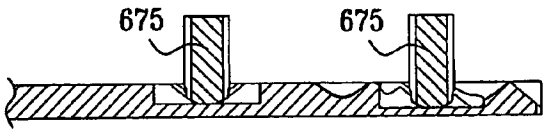
Figure 35E:
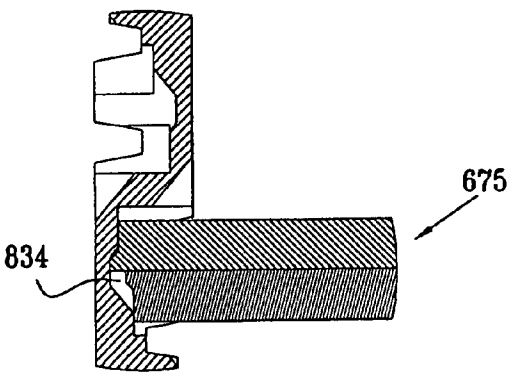
Figure 35F:
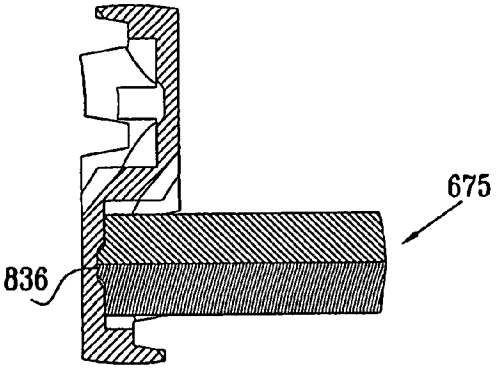
Figure 35A:
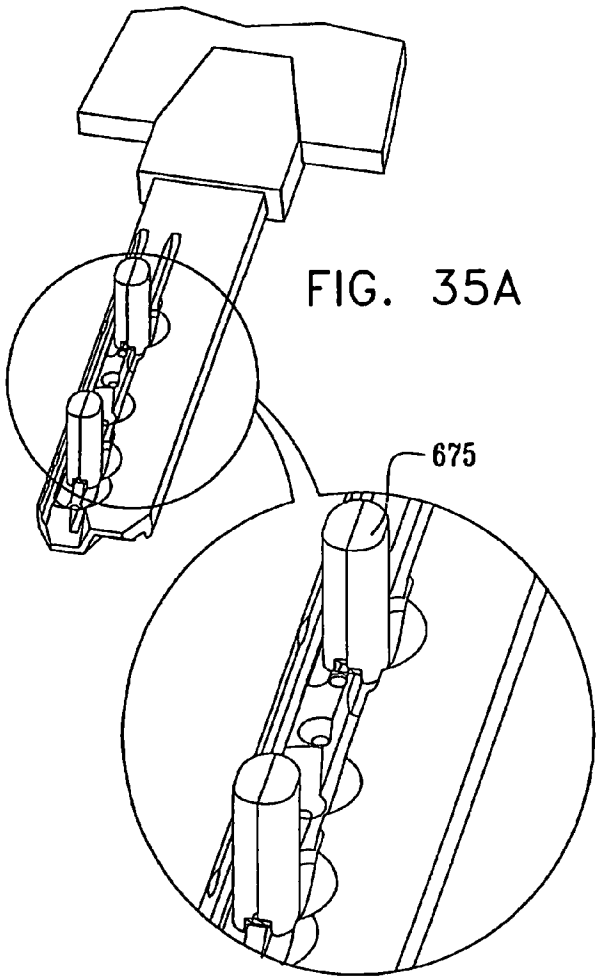

Reference is now made to FIGS. 31A-31E, which are, respectively, a pictorial illustration, a plan view illustration and a plurality of sectional illustrations of the key produced from the partially key cut key blank of the type shown in FIGS. 29A-29E in operative engagement with the multi-part plug pin of FIGS. 27A-27F. FIGS. 31A-31E illustrate engagement of multi-part plug pin 675 (FIGS. 27A-27F) with second key cut 734 (FIG. 29E). It is seen that due to the provision of additional grooves 718 and 720 (FIGS. 28A and 28B) of suitably different depths in the second key cut 734 (FIG. 29E), which accommodate elongate protrusions 692 and 694 (FIGS. 27A-27F) on respective parts of the multi-part pin, the multi-part pin 675 is enabled to seat fully in the second key cut. It is appreciated that multi-part pins of equal length and key blanks with additional grooves of corresponding equal depths may also be provided.

Reference is now made to FIGS. 32A-32D, which are, respectively, a plan view and a plurality of sectional illustrations of a key blank constructed and operative in accordance with still another preferred embodiment of the present invention. As seen in FIGS. 32A-32D, the key blank comprises a head portion 800 and a shank portion 802, preferably in the form of a flat blade having first and second oppositely-facing planar surfaces 804 and 806. Formed on each of planar surfaces 804 and 806 are a pair of guide grooves, respectively designated by reference numerals 808 & 810 and 812 and 814, which define a key-cut region on each surface. In accordance with a preferred embodiment of the invention a plurality of pairs of additional grooves are formed at a plurality of key cut locations in the key-cut region of each of planar surfaces 804 and 806. These additional grooves are designated by reference numerals 817, 818, 819 & 820 and 821, 822, 823 and 824 respectively and are shown to have differing depths.

It is a particular feature of the present invention that additional grooves 817-824 define part of the second key cuts referred to hereinabove and are absent from the first key cuts referred to hereinabove.

Key blanks configured generally as shown in FIGS. 32A-32D may have one or more grooves located selectably at different key cut locations, thereby to define second key cut locations. It is appreciated that by selective distribution of key blanks of the type shown in FIGS. 32A-32D, having given second key cut locations, cutting of keys having corresponding second key cut locations may be correspondingly restricted. The provision of different depths of the grooves provides a facility suitable for use in mastering keys.

Reference is now made to FIGS. 33A-33F, which are, respectively, a pictorial illustration, a plan view illustration and a plurality of sectional illustrations of a partially key cut key blank of the type shown in FIG. 32A-32D. The key blank of FIGS. 33A-33F is identical to that of FIGS. 32A-32D and is formed with additional key cuts, each having a generally truncated conical configuration, similar to that of a first key cut, over each pair of additional grooves, thus fully defining second key cuts on each of planar surfaces 804 and 806. The second key cuts, which are each a combination of a pair of additional grooves and the additional truncated conical key cut, are identified by reference numeral 834 on planar surface 804 and by reference numeral 835 on planar surface 806. Additional second key cuts which are each a combination of an additional groove and an additional truncated conical key cut are identified by reference numerals 836 on planar surface 804 and by reference numerals 837 on planar surface 806.

Key blanks configured generally as shown in FIGS. 33A-33F may have second key cuts located selectably at different key cut locations, thereby to define second key cut locations. It is appreciated that by selective distribution of key blanks of the type shown in FIGS. 33A-33F, having given second key cut locations, cutting of keys having corresponding second key cut locations may be correspondingly restricted. The provision of different depths of the grooves provides a facility suitable for use in mastering keys.

Reference is now made to FIGS. 34A-34F, which are, respectively, a pictorial illustration, a plan view illustration and a plurality of sectional illustrations of a key produced from the partially key cut key blank of the type shown in FIGS. 33A-33F. The difference between the key of FIGS. 34A-34F and the key blank of FIGS. 33A-33F is in the addition of first key cuts at additional locations along the key cut region on each of planar surfaces 804 and 806. The additional key cuts are indicated generally by reference numeral 844 on planar surface 804 and are not shown on planar surface 806.

Reference is now made to FIGS. 35A-35F, which are, respectively, a pictorial illustration, a plan view illustration and a plurality of sectional illustrations of the key produced from the partially key cut key blank of the type shown in FIGS. 33A-33F in operative engagement with plug pins of FIGS. 27A-27F. FIGS. 35A-35F illustrate engagement of a multi-part plug pin 675 (FIGS. 27A-27F) having parts of different lengths with second key cut 834 and engagement of a multi-part plug pin 675 having parts of identical lengths with second key cut 836. It is seen that due to the provision of additional grooves in the second key cuts, which accommodate elongate protrusions 692 and 694 (FIGS. 27A-27B) the multi-part pins 675 are enabled to seat fully in the second key cuts. It is appreciated that multi-part pins 675 could not seat fully in a first key cut. Accordingly keys which do not include suitably placed second key cuts cannot operate the non-conventional cylinders of the type described herein.

It will be appreciated by persons skilled in the art that the present invention is not limited by what has been particularly shown and described hereinabove. Rather the scope of the present invention includes both combinations and subcombinations of the various features described hereinabove as well as variations and modifications which would occur to persons skilled in the art upon reading the specification and which are not in the prior art.

The invention claimed is:

1. A key comprising:

a shank for use with a first pin operated cylinder having a plurality of first pins and at least one second pin, said shank also being for use with a second pin operated cylinder having a plurality of only first pins without said at least one second pin;

said shank defining at least one planar surface configured to define a longitudinally extending key-cut region thereon, said longitudinally extending region having formed thereon a plurality of first key cuts configured to position the plurality of first pins of the first pin operated cylinder at first-pin shear line positions when the key is fully inserted in the first pin operated cylinder, and having pre-formed thereon at least one second key cut configured to position at least one second pin at a second-pin shear line position when the key is fully inserted in the first pin operated cylinder, wherein said plurality of first key cuts define first recesses corresponding in configuration to said first pins, and wherein said at least one second key cut defines a first recess portion corresponding to one of said first recesses and configured to position one of said first pins at one of said first-pin shear line positions when the key is fully inserted in the second pin operated cylinder, and at least one second recess portion which is cut deeper than said first recess portion and which is configured to position said at least one second pin at said second-pin shear line position when the key is fully inserted in the first pin operated cylinder;

wherein said at least one second key cut has a shape defined by a combination of a guide groove, an additional groove and an additional key cut having a generally truncated conical configuration formed over said additional groove, said additional key cut corresponding to the plurality of first key cuts.

2. A key according to claim 1, wherein said plurality of first key cuts is incapable of positioning said at least one second pin at said second-pin shear line position.

3. A cylinder and key combination, wherein a key is usable for first and second pin operated cylinders, comprising:

a first pin operated cylinder including a cylinder body, a plug rotatable within said cylinder body and defining a keyway and comprising first pins and at least one second pin communicating with said keyway and being selectably positionable by key cuts on a key fully inserted into said keyway for positioning said first pins and said at least one second pin at respective first-pin and second-pin shear line positions with respect to a shear line between said cylinder body and said plug to permit rotation of said plug with respect to said cylinder body; and a key for use with said first pin operated cylinder and for use with a second pin operated cylinder having a plurality of only first pins without said at least one second pin, wherein said key comprises a shank defining at least one planar surface configured to define a longitudinally extending key-cut region thereon, said longitudinally extending region having formed thereon a plurality of first key cuts configured to position said first pins of the first pin operated cylinder at said first-pin shear line position when the key is fully inserted in the first pin operated cylinder, and having pre-formed thereon at least one second key cut configured to position said at least one second pin at said second-pin shear line position when the key is fully inserted in the first pin operated cylinder, and wherein said plurality of first key cuts define first recesses corresponding in configuration to said first pins and said at least one second key cut defines a first recess portion corresponding to one of said first recesses and configured to position one of said first pins at one of said first-pin shear line positions when the key is fully inserted in the second pin operated cylinder, and at least one second recess portion which is cut deeper than said first recess portion and which is configured to position said at least one second pin at said second-pin shear line position when the key is fully inserted in the first pin operated cylinder;

wherein said at least one second key cut has a shape defined by a combination of a guide groove, an additional groove and an additional key cut having a generally truncated conical configuration formed over said additional groove, said additional key cut corresponding to the plurality of first key cuts.

4. A cylinder and key combination according to claim 3 and wherein said plurality of first key cuts is incapable of positioning said at least one second pin at said second-pin shear line position.

5. A cylinder and key combination according to claim 3 and wherein said at least one second pin comprises a multi-part pin.

6. A cylinder and key combination according to claim 3, wherein said at least one second pin of said plug has a generally oval cylindrical configuration, and said first pins of said plug have a generally circular cylindrical configuration.

7. A cylinder and key combination according to claim 3, wherein said at least one second pin of said plug has a generally symmetric oval head configuration, and said first pins of said plug have a generally circularly symmetric, conical pin head configuration.

8. A cylinder and key combination, wherein a key is usable for first and second pin operated cylinders, comprising:

a first pin operated cylinder including a cylinder body, a plug rotatable within said cylinder body and defining a keyway and comprising first pins and at least one second pin communicating with said keyway and being selectably positionable by key cuts on a key fully inserted into said keyway for positioning said first pins and said at least one second pin at respective first-pin and second-pin shear line positions with respect to a shear line between said cylinder body and said plug to permit rotation of said plug with respect to said cylinder body; and a key for use with said first pin operated cylinder and for use with a second pin operated cylinder having a plurality of only first pins without said at least one second pin, wherein said key comprises a shank defining at least one planar surface configured to define a longitudinally extending key-cut region thereon, said longitudinally extending region having formed thereon a plurality of first key cuts configured to position said first pins of the first pin operated cylinder at said first-pin shear line position when the key is fully inserted in the first pin operated cylinder, and having pre-formed thereon at least one second key cut configured to position said at least one second pin at said second-pin shear line position when the key is fully inserted in the first pin operated cylinder, and wherein said plurality of first key cuts define first recesses corresponding in configuration to said first pins and said at least one second key cut defines a first recess portion corresponding to one of said first recesses and configured to position one of said first pins at one of said first-pin shear line positions when the key is fully inserted in the second pin operated cylinder, and at least one second recess portion which is cut deeper than said first recess portion and which is configured to position said at least one second pin at said second-pin shear line position when the key is fully inserted in the first pin operated cylinder, wherein said at least one second pin has a generally oval cylindrical configuration, a head of said at least one second pin defining an elongate protrusion which extends along an axis and an inclined plane extending downwardly from each side of said elongate protrusion, a first conical surface extending downwardly from one end of said elongate protrusion which joins a second conical surface, and another elongate protrusion that extends on either side of said second conical surface.

9. A cylinder and key combination, wherein a key is usable for first and second pin operated cylinders, comprising:

a first pin operated cylinder including a cylinder body, a plug rotatable within said cylinder body and defining a keyway and comprising first pins and at least one second pin communicating with said keyway and being selectably positionable by key cuts on a key fully inserted into said keyway for positioning said first pins and said at least one second pin at respective first-pin and second-pin shear line positions with respect to a shear line between said cylinder body and said plug to permit rotation of said plug with respect to said cylinder body; and a key for use with said first pin operated cylinder and for use with a second pin operated cylinder having a plurality of only first pins without said at least one second pin, wherein said key comprises a shank defining at least one planar surface configured to define a longitudinally extending key-cut region thereon, said longitudinally extending region having formed thereon a plurality of first key cuts configured to position said first pins of the first pin operated cylinder at said first-pin shear line position when the key is fully inserted in the first pin operated cylinder, and having pre-formed thereon at least one second key cut configured to position said at least one second pin at said second-pin shear line position when the key is fully inserted in the first pin operated cylinder, and wherein said plurality of first key cuts define first recesses corresponding in configuration to said first pins and said at least one second key cut defines a first recess portion corresponding to one of said first recesses and configured to position one of said first pins at one of said first-pin shear line positions when the key is fully inserted in the second pin operated cylinder, and at least one second recess portion which is cut deeper than said first recess portion and which is configured to position said at least one second pin at said second-pin shear line position when the key is fully inserted in the first pin operated cylinder, wherein said at least one second pin has a generally oval cylindrical configuration defining a major axis and a minor axis, a head of said at least one second pin defining an elongate generally rectangular protrusion which extends along the minor axis and an inclined plane extending downwardly from each side of said elongate protrusion, a first conical surface extending downwardly from one end of said elongate protrusion which joins a second conical surface, and another elongate protrusion that extends on either side of said second conical surface.

* * * * *